US007493734B2

(12) United States Patent
Kramer

(10) Patent No.: US 7,493,734 B2
(45) Date of Patent: Feb. 24, 2009

(54) TILE AND TILE ASSEMBLY FOR A ROOF

(75) Inventor: Kurt J. Kramer, 4033 Tenango Rd., Claremont, CA (US) 91711

(73) Assignee: Kurt J. Kramer, Claremont, CA (US)

( * ) Notice: Subject to any disclaimer, the term of this patent is extended or adjusted under 35 U.S.C. 154(b) by 63 days.

(21) Appl. No.: 11/414,771

(22) Filed: Apr. 28, 2006

(65) Prior Publication Data

US 2007/0251178 A1 Nov. 1, 2007

(51) Int. Cl.
*E04D 1/00* (2006.01)

(52) U.S. Cl. ..... 52/554; 52/519; 52/535

(58) Field of Classification Search ..... 52/554, 52/553, 535, 519; 411/483–486
See application file for complete search history.

(56) References Cited

U.S. PATENT DOCUMENTS

| | | | | | |
|---|---|---|---|---|---|
| 202,953 | A | * | 4/1878 | Merrill | 52/542 |
| 267,904 | A | * | 11/1882 | Lane et al. | 52/536 |
| 1,335,756 | A | | 4/1920 | Scarff | |
| 2,093,261 | A | | 9/1937 | Willson | |
| 2,133,363 | A | * | 10/1938 | Talmage | 52/521 |
| 2,505,343 | A | * | 4/1950 | Stolz | 52/557 |
| 3,874,141 | A | * | 4/1975 | Olson et al. | 52/630 |
| 4,720,955 | A | | 1/1988 | Kane | |

OTHER PUBLICATIONS

International Search Report for corresponding PCT application PCT/US07/09011 lists the references above.

* cited by examiner

*Primary Examiner*—Brian Glessner
*Assistant Examiner*—Adriana Figueroa
(74) *Attorney, Agent, or Firm*—Hogan & Hartson LLP

(57) ABSTRACT

A tile assembly having a plurality of tiles adapted to join in an interlocking and repeating fashion. A plurality of tile assemblies can be joined to each other to form a roof. Each tile assembly includes left and right center tiles positioned side-by-side. Each tile has a generally diamond shaped main surface with vertically spaced upper and lower apices and laterally spaced lateral apices. Two upper flanges extend upwardly and outwardly from the main surface along upper edges and are joined in an upper flange apex. Each center tile includes two lower flanges that extend downwardly and outwardly from the main surface along the lower edges. The tile assembly includes upper and lower tiles of the same configuration. The upper tile fits over the adjacent upper flanges of the two center tiles, and the lower tile fits beneath the adjacent lower flange of the two center tiles.

20 Claims, 19 Drawing Sheets

FIG. 4
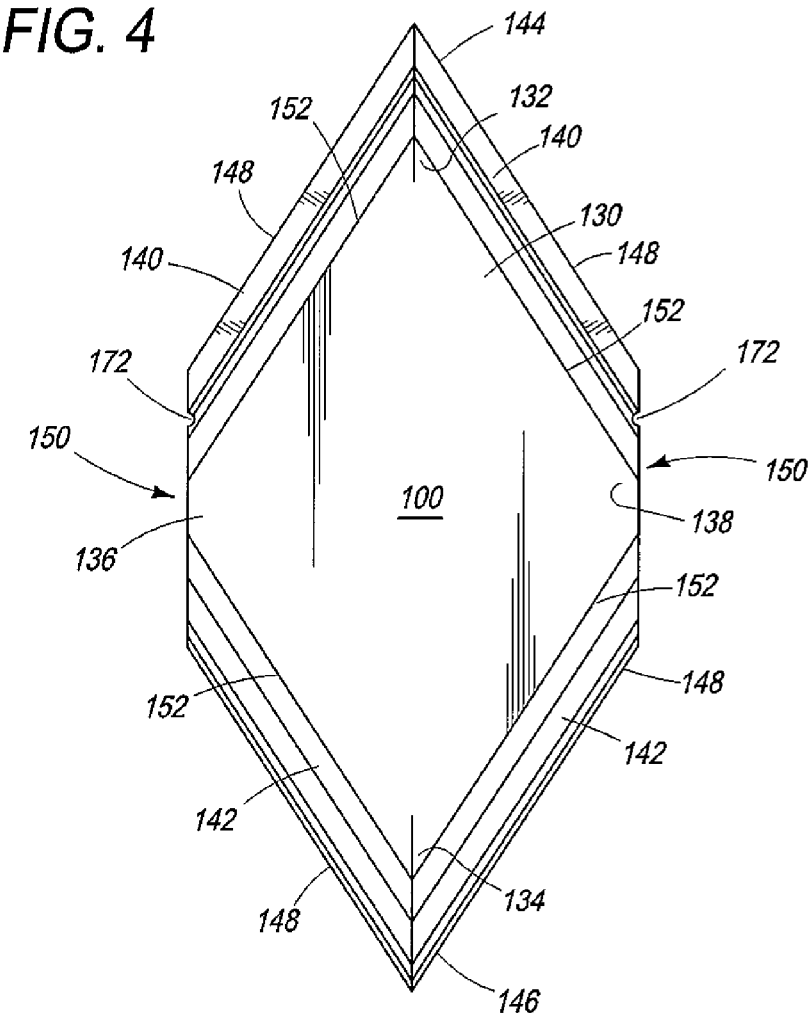
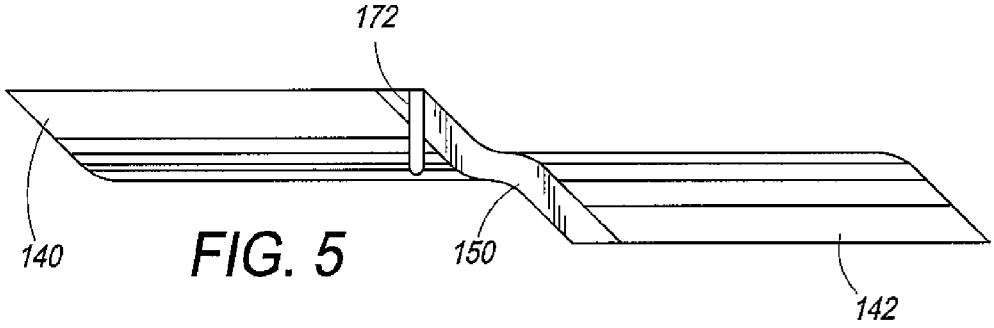
FIG. 5

FIG. 6
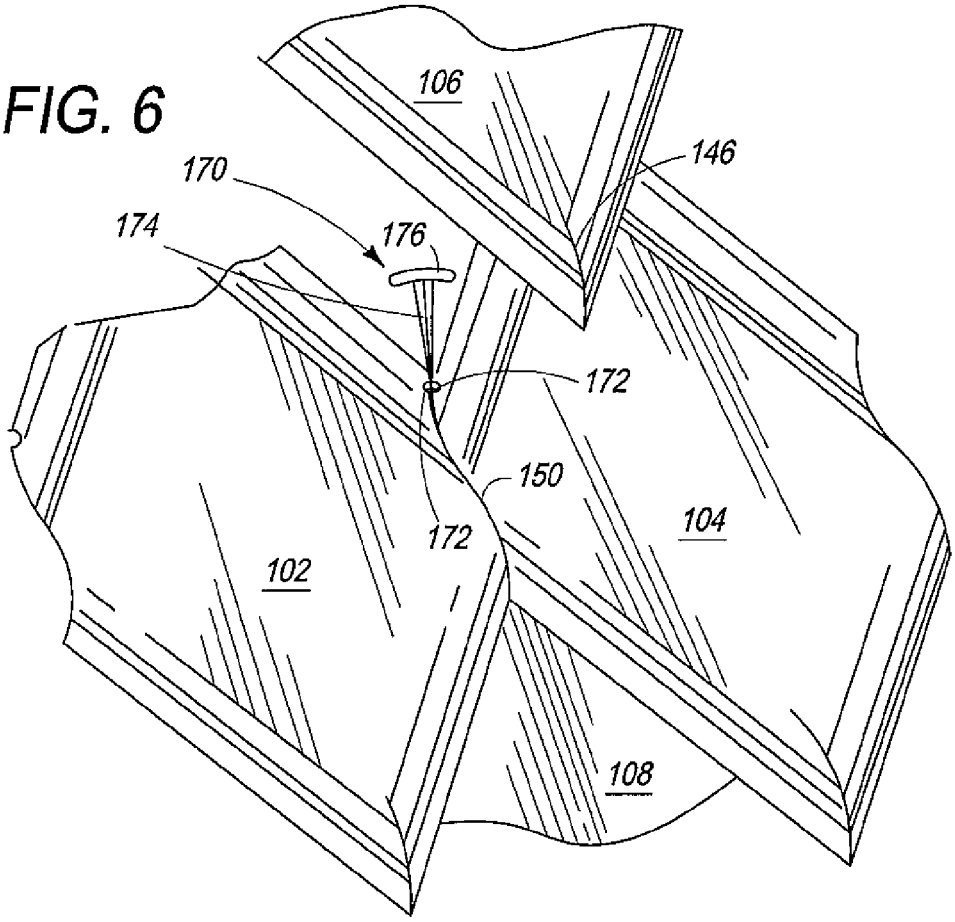
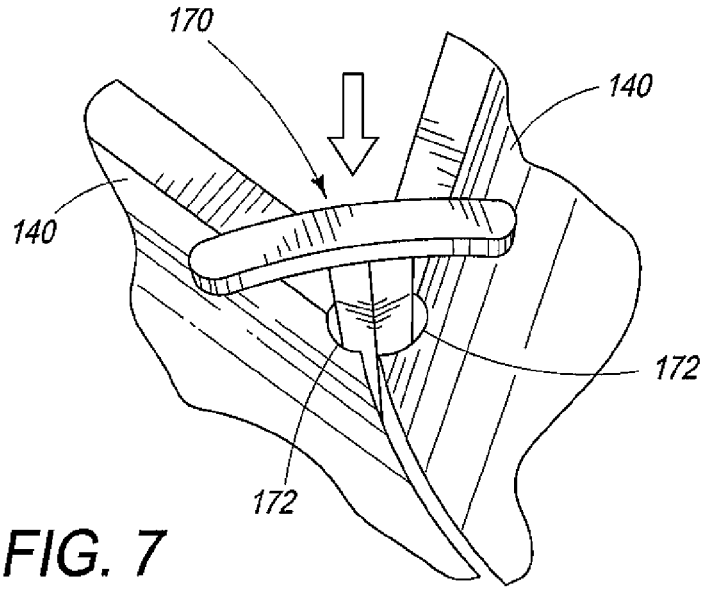
FIG. 7

TILE AND TILE ASSEMBLY FOR A ROOF

BACKGROUND OF THE INVENTION

1. Field of the Invention

The present invention relates to roofing tiles.

2. Description of Related Art

The art of roofing tiles extends back over centuries involving a variety of media, such as fired clay, slate, and wood shingles. In general, tiles can be formed with a variety of shapes. For example, rectangular tiles arranged in overlapping rows are a common roofing style. Some styles include curves or angles on exposed segments and supporting areas that give the tile a three-dimensional look on a flat roof. These tiles can be formed of fired clay, cement, and metal.

Some tiles are configured with a diamond shape in which the lower axis of the diamond extends in a direction generally perpendicular to the roof line. Diamond shaped tiles involve somewhat more complex arrangements for securing and overlapping the tiles than do straightforward rectangular tiles. One such type of rectangular tile includes a generally diamond shaped flat main surface having upwardly turned flanges along its upper two diamond edges and downwardly turned flanges along its lower two diamond edges. The flanges of this tile extend in a perpendicular relation to the main surface. Considering two vertically spaced upper and lower rows of tiles according to such arrangement, the downwardly facing flanges along the lower edges of the tiles in the upper row hook over the upwardly facing flanges along the upper edges of the tile in the lower row, and connector pins are driven into the underlying roof laths through appropriately positioned openings through the tiles.

While tiles of the prior art type, as previously described, are generally satisfactory, certain disadvantages are associated with such a structure. The use of flanges which contact the surfaces of different tiles essentially at right angles tends to give a rather "blocky" or abrupt appearance to the assembled groups of tiles rather than a smooth flowing transition. The essentially perpendicular flange relationships would tend to interfere with laminar flow of wind over the roof, which create eddies and turbulence with increased wind resistance. In general, wind resistance is undesirable in a roofing system due to increases in wind noise and, in severe wind conditions over time, can contribute to the earlier loosening of tiles and reduced roof life. Reducing the wind resistance of a tile system and providing a good means of attachment to the roof deck provide better protection from high winds.

In addition, this prior art type of tile fails to compensate for structural variations of the tiles due to imprecise manufacturing techniques involved in tile making. These structural variations of the tiles can lead to difficulties in fitting tiles together due to interference fits and instances of roofers installing tiles imprecisely on the roof laths such that they are to some degree misaligned. Sometimes, the roof deck may not be perfectly flat which contributes to the alignment problem.

Another problem that can arise with tiles of this character is in connection with water that tends to run down the exposed surfaces of the tiles. Water can run under the flanges and flow in the channels defined by the space between adjacent flanges of the tiles. While such water movement cannot be entirely avoided, there should be ways to reduce the opportunity for such channeled water to pass through the roof tiles onto the underlying structure.

SUMMARY OF THE INVENTION

The present invention relates to roofing tiles intended to provide a repeating, diamond shaped, three-dimensional, streamline impression, having improved resistance to wind effects and capable of accommodating variations in the dimensions or positioning of individual tiles. The present invention further relates to an assembly of roofing tiles for a similar function and purpose.

In one aspect, the tile and tile assembly of the present invention give a roof an attractive repeating diamond pattern with a three-dimensional surface in which the edges of overlapping tiles slope together in a streamlining manner. Such a surface is intended to be visually attractive and contribute to a more laminar flow of wind over the roof to thereby reduce wind resistance and providing improved resistance to high wind tile blow off and to thereby avoid excessive noise along with enhancing the life of the roof against loosening from the effects of wind. Moreover, the tile assembly is adapted to accommodate tile imperfections and misalignments during installation and reduce opportunities for leakage of water through the roof.

In one embodiment, the tile assembly includes a set of four tiles that are adapted to connect in a repeating manner. A plurality of tile assemblies can be connected to each other in a surrounding manner to provide the roof. Each four tile assembly includes left and right center tiles, side by side with each other. Each tile has a generally diamond shaped main surface with vertically spaced upper and lower apices and a laterally spaced lateral apices. Two upper flanges extend along the upper edges of each center tile extending upwardly and outwardly at an obtuse angle from the main surface and are joined in an upper flange apex. Each center tile includes two lower flanges that extend along the lower edges of the main surface downwardly and outwardly at an obtuse angle. The tile assembly includes upper and lower tiles, of the same configuration. The upper tile fits over the adjacent upper flanges of the two center tiles while the lower tile fits beneath the adjacent lower flange of the two center tiles.

This arrangement provides a tile assembly in which the overlapping tile edges have a streamlined appearance in which the transitions between surfaces of tiles, which are at different elevations relative to each other, are blended smoothly by the intervening overlapping flanges. Thus, air flowing over relatively lower and higher tile surfaces is encouraged to flow in a more nearly laminar condition over the transitions so that eddies and other turbulence-inducing phenomena are reduced.

In another embodiment, at the lateral apex of each tile, the edges of the upper and lower flanges and of the main surface blend together to form an inflection edge extending in a plane perpendicular to the main surface. Each flange has an outer edge parallel to the main surface of the tile and a transition edge extending from the outer edge to the adjacent lateral axis of the tile. The inflection edge includes the transition edges of the upper and lower flanges, which extend above and below the main surface and the adjacent portion of the main surface. The two center tiles have inflection edges next to each other. The inflection edges reduce the disadvantageous effects of manufacturing variances or slight misalignment on the lath 190 by the installer to be easily fitted together in the installing process.

The arrangement by which the lower flange apex of the upper tile overlaps and covers the inflection edges of the center tiles makes it difficult for water to enter and pass the line of intersection of the two edges. Further, at the opposite end of each center tile, the upturned flanges at the upper end of the bottom tile are adapted to serve as a drain pan beneath the inflection edges of the two center tiles to collect water that passes through. The water can be directed over the outer surface of the bottom tile. In one aspect, the lower flange apex of the upper tile does not necessarily overlap the entire inflection edges intersection due to the streamlined lower flanges that are directly exposed to water. Reducing the gap between the inflection edge intersection and redirecting water back out onto the main surface is accomplished through the use of a lower rain gusset. The lower rain gusset fits under the lower portions of the inflection edges of two adjacent center tiles to provide additional protection against the ingress of water through the intersection of the inflection edges. To facilitate the redirection of water out from the gusset to the exposed main tile surface, an open area at the junction of the lower inflection edges at the main tile surface of the bottom tile allows water to be directed out by the gusset. This can be accomplished by rounding the end of the lower inflection edges. The gusset keeps the inflection edges of the center tiles close together and in alignment.

In still another embodiment, the upper flange of each tile, in the inflection edge region, is notched to accommodate the passage of a two headed nail so as to simplify the installation of the tiles. The two headed nails each have a shaft and a head which extends oppositely in two directions to overlap the edges of two adjacent tiles. When the connector is driven into place in the lath, its head region overlaps and grips the tile in its notched regions to hold it in place. The notch, which is oversize in relation to the size of the nail shift permit the connector to have some freedom of installation. This freedom, aided by the inflection edge itself which accommodates some misalignment of the adjacent edges of two center tiles, provides for an installation which is forgiving of structural variations in the manufacturing tolerances of tiles and accommodates some carelessness on the part of the installer in positioning the connectors when driven into the underlying layer or lath.

In one aspect, the two headed nail may include features, such as a lining to absorb shocks and to hold the upper abutting flanges together. An alternative embodiment of the flange may have an extension which interlocks with a catch underneath and a part of the top tile to further improve the wind blow off resistance and to keep the tiles aligned.

One further embodiment of the invention resides in a supplemental upper rain gusset which can be used, as an alternative embodiment. The rain gusset fits over the upper portions of the inflection edges of two adjacent center tiles to provide additional protection against ingress of water through the adjacent inflection edges to the roof.

In yet another embodiment, which can further improve wind resistance of the tile system and which provides a different appearance, the tile or tile assembly may include a narrowed tile. In comparison to the previous embodiments, the inflection edges of the narrowed tile are parallel to, but closer to the center of the tile than the previous embodiments. The main surface segment of the inflection edge allows the bottom edge flange apex to rest fully on the inflection edge. This design feature provides more wind resistance because the tip of the bottom edge flange apex is not protruding out over the lower infection edge juncture of the two center tiles. This embodiment is more applicable to thick tiles because thick tiles have a significantly more protruding bottom edge flange apex. In one aspect, this feature of the tiles allows for narrowing one or more lateral sides of the tiles to allow fitting tiles into a narrower space.

As a result of these features of the present invention, a roof built up of tile assemblies according to the invention provides a visually attractive, diamond shaped pattern having a three dimensional streamline look which is intended to have reduced resistance to wind and to be effective in moving rain off the roof with reduced intrusion of water through the roof.

Water which may be trapped behind flanges and run between channels by gravity can flow to the upper inflection edge intersection. The upper flanges here act as a dam and direct water back out toward the main surface of the lower tile. Some of this water may flow through the intersection instead of over the inflection edge junction area where it can be caught by the upper apex of the bottom tile. If the water is damned up to a sufficient degree, the underlying upper flange apex may not be directly under to act as a catch basin and this water could travel to the under roof. To protect this potential, methods of extending the upper flange apex up the roof as compared to the upper inflection edges are provided.

Other features and advantages of the invention will be apparent from the following detailed description, taken in conjunction with the accompanying drawings which illustrate, by way of example, various features of embodiments of the invention.

BRIEF DESCRIPTION OF THE DRAWINGS

FIG. 4 is a top view of tile.

FIG. 5 is a side view of tile.

FIGS. 6-7 is a perspective view of the attachment of tiles to roof via nail fasteners.

FIG. 9F is the same size tile as in. FIG. 9E, with an improved upper edge catch basin by means of tile placement.

FIG. 10A top and bottom are views of non-narrowed tile with a cut line.

FIG. 10B top and bottom are views of a narrowed tile.

DETAILED DESCRIPTION OF THE INVENTION

Reference will now be made to the drawings wherein like numerals refer to like parts throughout.

Figure 1:
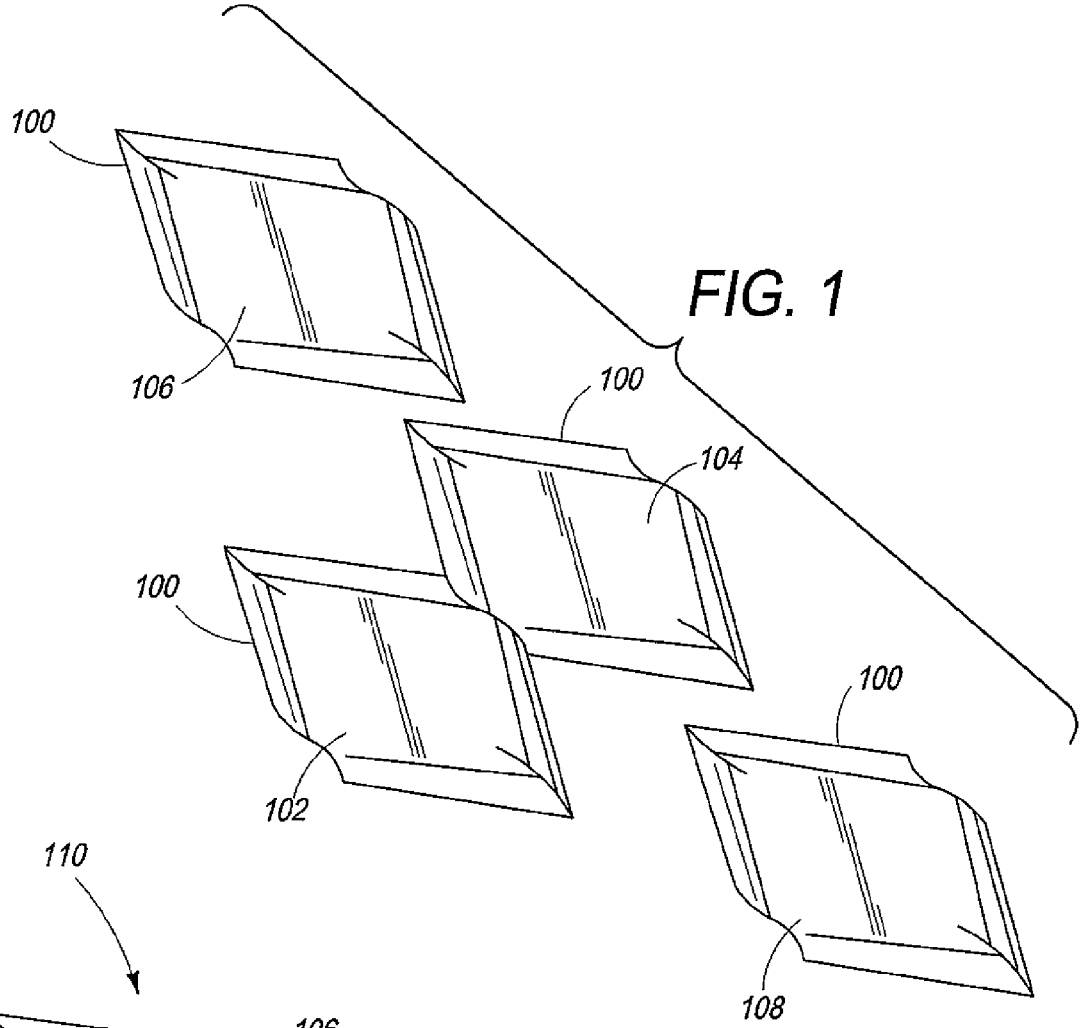
FIG. 1 is a perspective view of a plurality of tiles for assembly.
Figure 2:
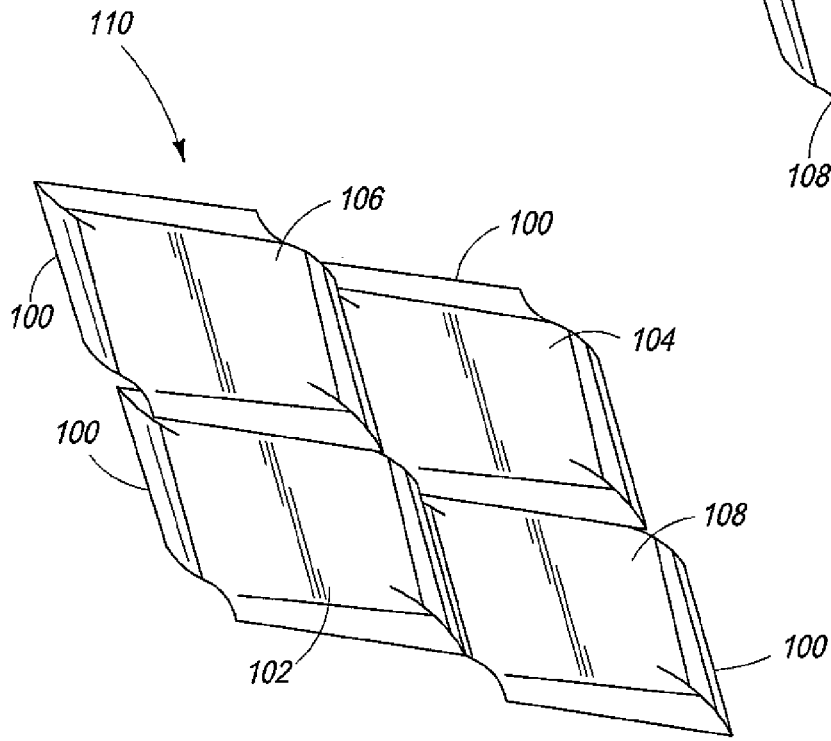
FIG. 2 is perspective view of a tile assembly.
Figure 3A:
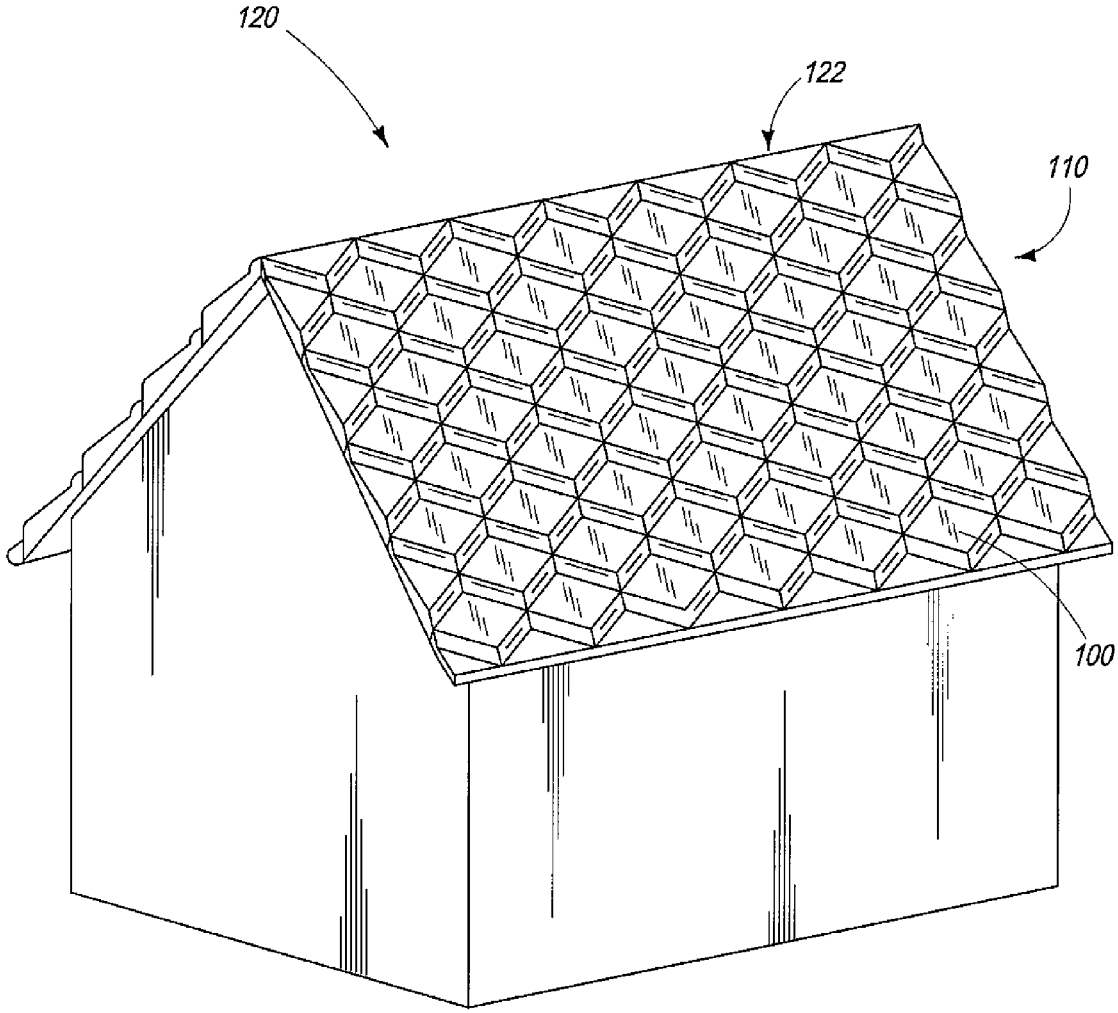
FIGS. 3A-3C are perspective views of a plurality of tiles and tile assemblies linked together with adjacent tile assemblies to form a roof of a structure.
Figure 3B:
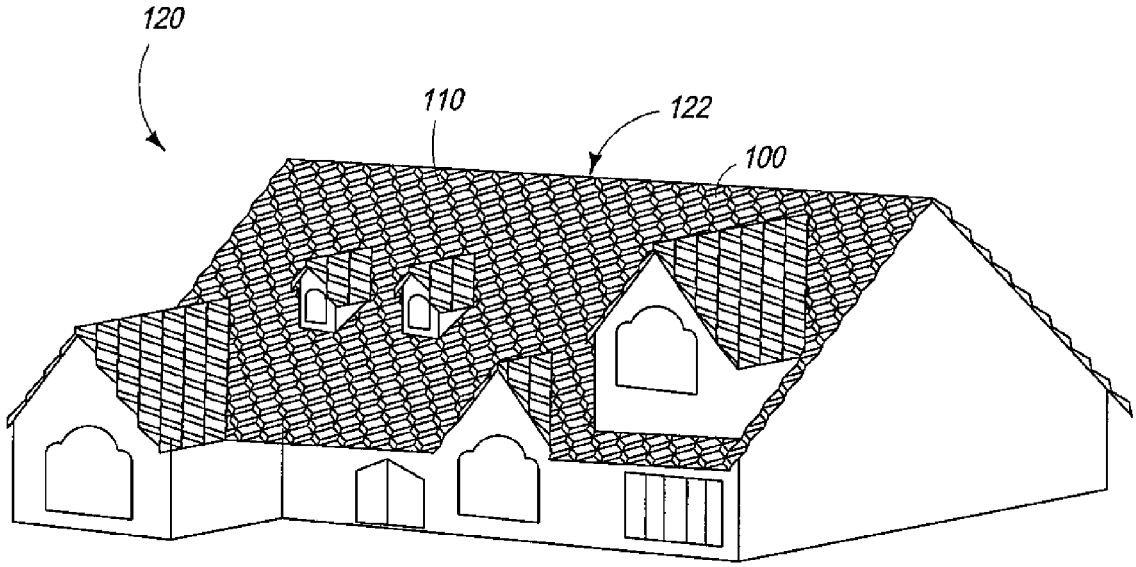
Figure 3C:
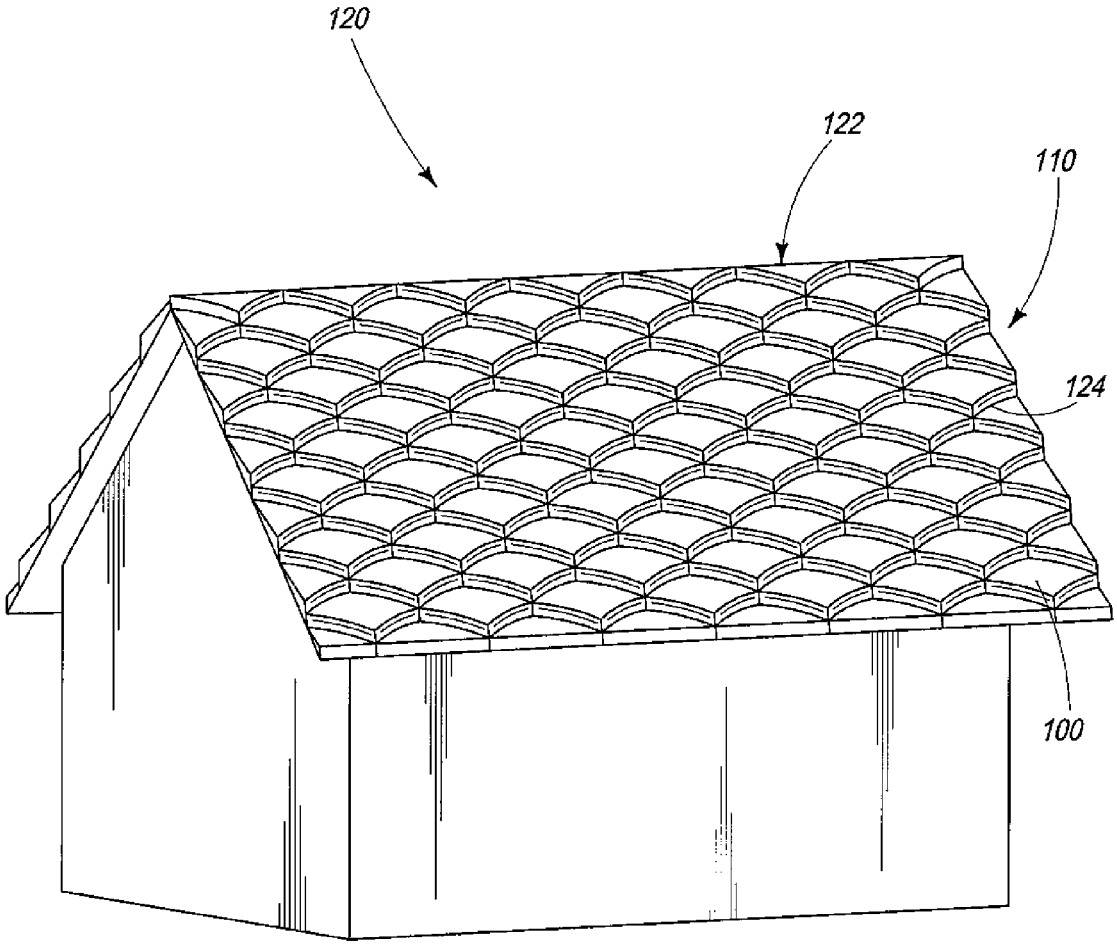

FIG. 1 illustrates one embodiment of a plurality of diamond shaped tiles 100 for assembly. FIG. 2 illustrates one embodiment of a tile assembly 110 having at least four tiles 100 grouped together in a diamond shaped pattern. FIGS. 3A-3C illustrate a plurality of tiles 100 and tile assemblies 110 linked together with adjacent tile assemblies 110 to form a roof 120 of a structure. Roof 120 extends in downwardly inclined planes from either side of a roof line 122. FIG. 4 illustrates a top view of tile 100, and FIG. 5 illustrates a side view of tile 100. In the following description, a single tile assembly 110 is described, but it will be understood that the flanges of each tile 100 hook over and interlock with the flanges of adjacent tiles 100 in a repeating pattern of tile assemblies 110 to form roof 120.

As shown in FIG. 1, each tile assembly 110 includes left and right center tiles 102, 104 disposed in a plane nearly parallel to the plane of roof 120. Center tiles 102, 104 are overlapped along their upper regions by an upper tile 106 while a lower tile 108 is positioned beneath the center tiles 102, 104. Each tile 102, 104, 106, 108 has a similar configuration. As shown in FIG. 4, each tile 102, 104, 106, 108 includes a generally diamond shape main surface 130 with upper and lower apices 132, 134 spaced apart along an axis perpendicular or nearly perpendicular to roof line 122. Main surface 130 includes left and right lateral apices 136, 138 spaced apart along an axis nearly parallel to roof line 122. Main surface 130 of tiles 102, 104, 106, 108 faces outwardly to the environment, including wind, rain, and sun, and creates a diamond shaped pattern effect. When tiles 102, 104, 106, 108 are assembled together, as shown in FIGS. 2, 3A-3C, tiles 102, 104, 106, 108 possess a pleasing streamline appearance. For example, FIG. 3A shows a diamond shaped pattern of tiles 100, and FIG. 3C shows a diamond shaped pattern of tiles 100 with curved outer peripheral features 124.

In one aspect, although at different relative elevations in a direction perpendicular to the plane of the roof, tiles 102, 104, 106, 108 in tile assembly 110 Blend together in a streamline contour that fosters laminar wind flow over the tiles to reduce wind resistance as compared to a tile arrangement in which overlapping flanges are substantially perpendicular to the tile surfaces 130.

To enable each tile 102, 104, 106, 108 to connect to adjacent tiles to the left, right, above, and below, each tile 102, 104, 106, 108 is provided with two upper flanges 140 and two lower flanges 142. Upper flanges 140 extend along the upper edges of main surface 130 between upper apex 132 and the lateral apices 136, 138 in an integral manner. Upper flanges 140 incline upwardly and outwardly from main surface 130 at a generally obtuse angle and join together at the upper end of each tile 102, 104, 106, 108 to form an upper flange apex 144. Lower flanges 142 incline downwardly and outwardly from the lower two edges of the main surface 130 at a similar obtuse angle, but in a downward direction. Lower flanges 142 join to form a lower flange apex 146. Upper and lower flanges 140, 142 are generally similar in height perpendicular to main surface 130 and in shape.

Each flange 140, 142 extends laterally for a first distance of approximately, for example, one-twelfth to one-half of the transverse width of main surface 130 measured in a direction perpendicular to each flange 140, 142. Each flange 140, 142 includes an outer edge 148, which is spaced from and extends generally parallel to main surface 130, and a transition edge 152, which extends between outer edges 148 and main surface 130 at lateral apices 136, 138. In one aspect, flanges 140, 142 include a radial contour as they extend out and upward or out and downward, respectively, from main surface 130 of each tile 102, 104, 106, 108.

When tiles 102, 104, 106, 108 are connected together to form tile assembly 110, the inclination of the overlapping flange of one tile to main surface 130 for the next overlapped tile provides a smooth, streamline transition due to the obtuse angles chosen. In one embodiment, the obtuse angle at which each flange extends in relation to main surface 130 into which it blends is approximately 135 degrees. However, it should be appreciated that other obtuse inclinations may be utilized without departing from the scope of the present invention. For example, obtuse inclinations within a range of approximately 110 to about 165 could be utilized. Within this range of obtuse angles and inclinations, flanges 140, 142 of adjacent tiles may overlap, as shown in FIG. 2, to provide a streamline relationship to accomplish a reduced wind resistance and an attractive streamline appearance.

Each tile 102, 104, 106, 108 may be formed from various types of materials, such as, for example, rigid materials including fired clay or cement for a thick type or style of tile and metal or steel for a thin type or style of tile. However, each tile 102, 104, 106, 108 may be formed of other materials such as, without limitation, fiberglass reinforced plastic, cement, metal, or various types of composite materials. In one aspect, an insulating foam backed tile alternate embodiment makes the tile thicker except at the flange overlaps.

As shown in FIGS. 4-5, an inflection edge 150, positioned along each lateral apex 136, 138 of each tile 102, 104, 106, 108, extends perpendicularly to the lateral axis and main surface 130 of each tile 102, 104, 106, 108. Inflection edge 150 includes transition edges 152 of upper and lower flanges 140, 142, which blend through a radius into main surface 130 to provide a region of inflection between transition edges 152. In one aspect, when tiles 102, 104, 106, 108 are assembled in tile assembly 110, as shown in FIG. 1, adjacent inflection edges 150 of the left and right center tiles 102, 104 are side-by-side in generally abutting relation, ready to be covered by the lower flange apex 146 of upper tile 106. Inflection edges 150 provide an advantage in that, if there is some manufacturing imperfection in the tiles that can create variations or differences between tiles, or if the installer carelessly positions some of the tiles during installation, then inflection edges 150 accommodate enough relative rotational and separational movement of the parts to enable tiles 102, 104, 106, 108 to be assembled despite the misalignment. As will be described in greater detail below, a narrowed tile, as shown, for example, in FIG. 10B, illustrates that tiles can be trimmed to an extent to allow for fitting together in tight spaces, while maintaining the essential tile properties.

Figure 13:
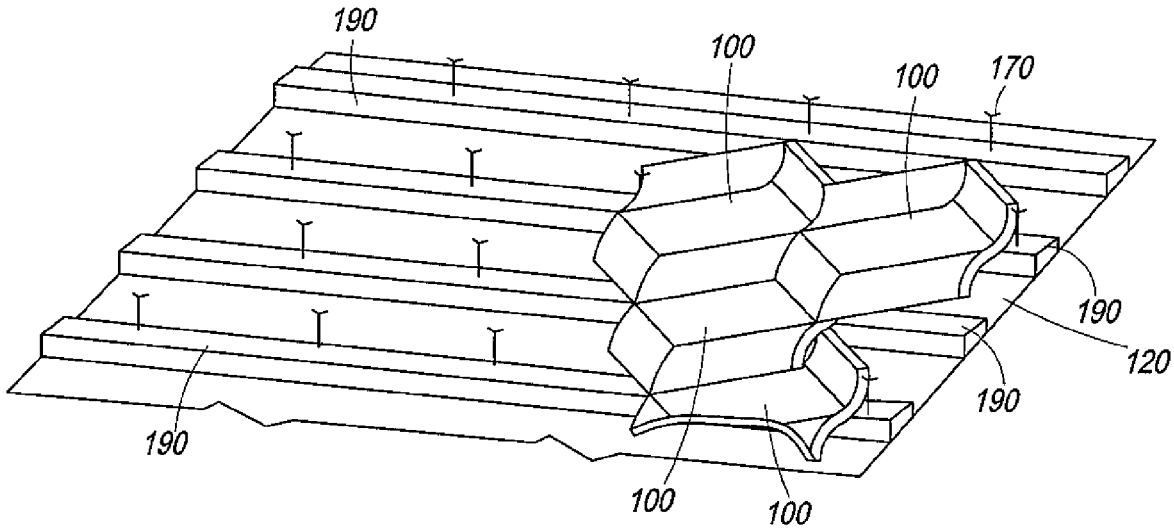
FIG. 13 shows fasteners pre-installed on laths.

In one embodiment, each tile 102, 104, 106, 108 of tile assembly 110 can be secured to the underlying laths 190, as shown in FIG. 13, of roof 120 that form at least part of the roof structure for many roof conditions. In general, these laths 190 are positioned nearly parallel to roof line 122 with similar spacing between each lath 190. Laths 190 are generally utilized for securing tiles, alignment, and added support against weight loads. The spacing of laths 190 from each other is related to the vertical dimensions of the tile to enable attachment. Air movement is free under the tiles when a lath 190 is utilized. It should be appreciated by those skilled in the art that the joined, interlocking flanges offer structural support. This is important for some tile variations where the ability to walk on the tile system may be important for maintaining a roof. This feature is in conjunction with the supporting lath.

FIGS. 6-7 illustrate the attachment of tiles 102, 104, 106, 108 to laths 190 of roof 120 via nail 170. In one embodiment, nail 170 includes a twin headed fastener with a central nail shaft 174 and a head 176 which extends in opposite, aligned directions from the top of the shaft. To receive each nail, upper flanges 140 of each tile 102, 104, 106, 108, in or adjacent to inflected edge 150, is provided with a vertical notch 172, as shown in FIGS. 4, 5, 6, 7. In another embodiment, notches 170 are sufficiently oversized in relation to nail shaft 174 of nail 170 to accommodate misalignments due to structural variations in the dimensions of each tile 102, 104, 106, 108 or minor positioning inaccuracies by the installer driving in fastening nail 170. In addition, nail 170 can be made with cushioning materials, so that installation does not break tiles 102, 104, 106, 108 during nail installation, such as, for example, a screw with a plastic washer in the shape of the two-headed nail head. This type of fastener can be used for brittle tiles, such as cement and clay. Nail 170 can be anchored directly to roof 120 or to a block as described for a lath 190 fastener 170.

When each fastening nail 170 is driven into position, the double head portions overlie and grip against the edges of upper flanges 140 to securely hold tiles 102, 104, 106, 108 against the lath. Once attached, tiles 102, 104, 106, 108 are less likely to move laterally from nail shaft 174 due to the secure attachment of another nail 170 received in an opposing notch 172 on the laterally opposite upper flange 140. Nail head 176 of nail 170 may have a softer material, such as, for example, rubber, nylon, or plastic, attached as a washer underneath to absorb shocks from weight loads for brittle tiles. Nail head 176 of nail 170 may also have a washer like attachment under head 176 that matches the contour of upper inflection edges 150 and, thus, further serves to retain tiles 102, 104, 106, 108 in position. In one aspect, nail head 176 of nail 170 may be formed of a semi-flexible material, such as, for example, brass, aluminum, or various types of soft alloys. This connector arrangement, coupled with the previously described advantage of inflection edges 150, enables tiles 102, 104, 106, 108 to be installed with some accommodation for variation in tile dimension due to the manufacturing process or misalignment by its installer. The fastener, along with securing and aligning tiles, also improves high wind blow-off resistance.

Figure 12A:
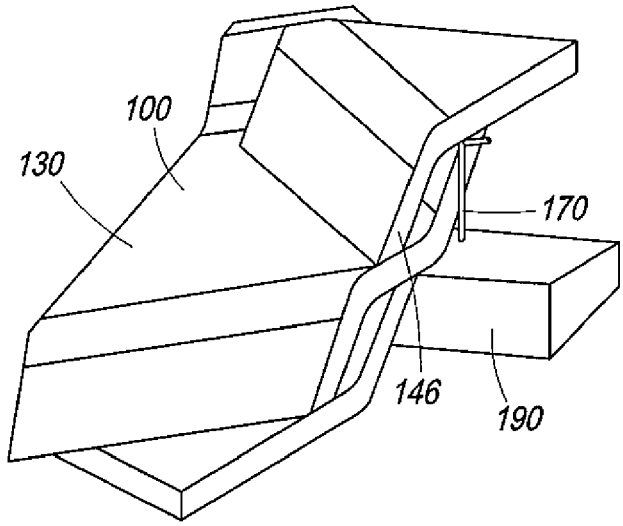
FIGS. 12A & 12B are cutaway close-ups of fastener as installed and fastener installed with catch and a hold down on the top tile.
Figure 12B:
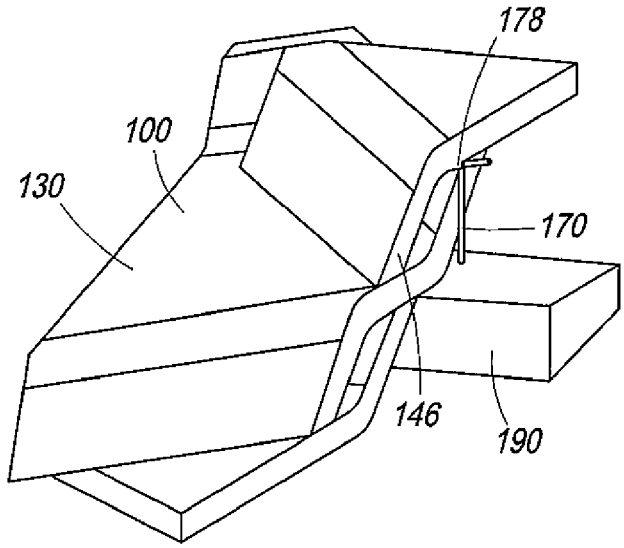

Another embodiment may incorporate an extension on the double head nail 170 or washer underneath nail head 176 of nail 170 to serve as a hold. FIG. 12B illustrates a matching catch 178 added to each tile 102, 104, 106, 108 underneath its lower apex 146 of its main surface 130. This may provide more blow-off resistance and serve to retain each tile 102, 104, 106, 108 in position. FIG. 12A shows a fastener 170 with lath 190.

Figure 8A:
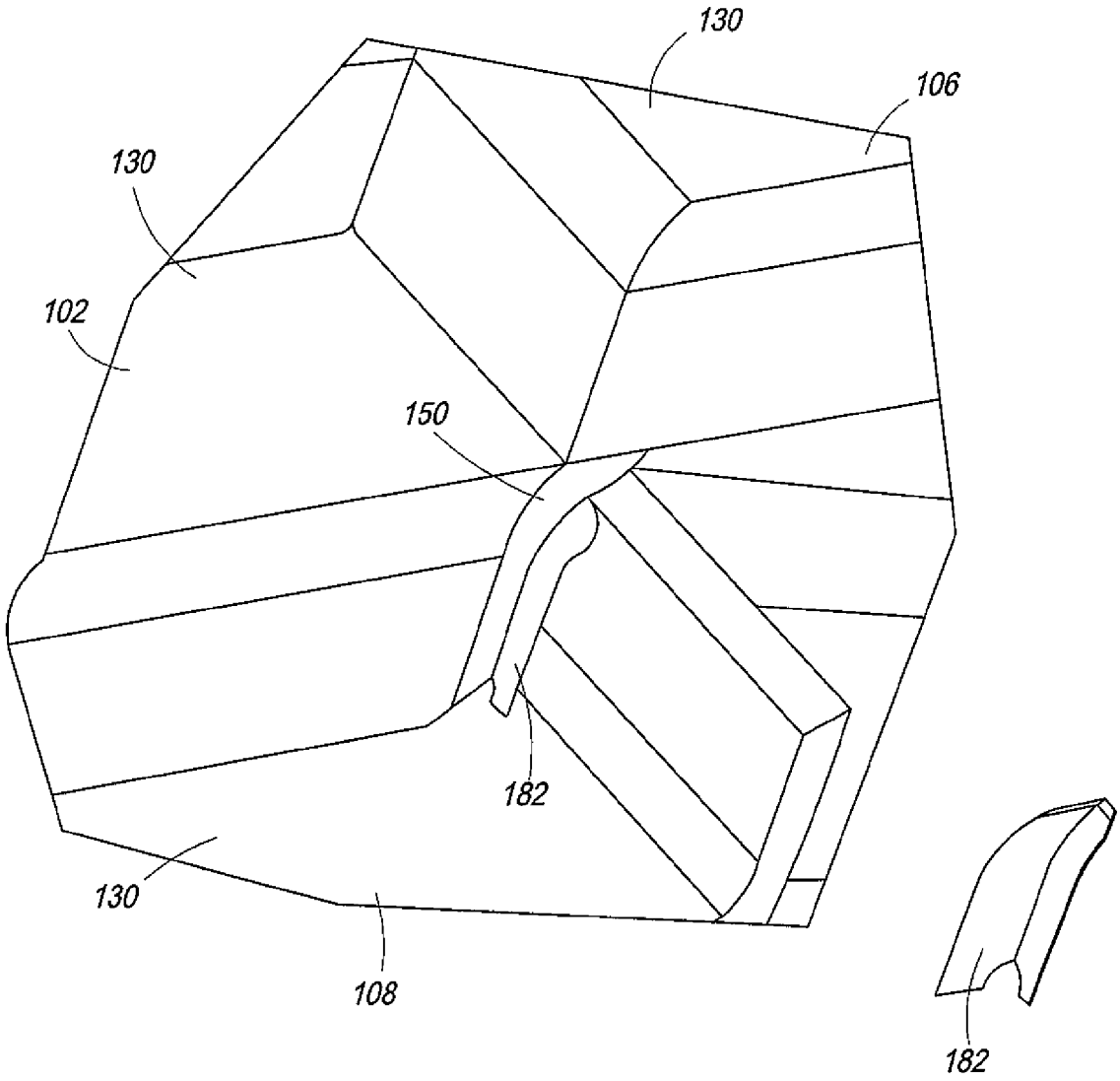
FIG. 8A is a perspective view of a lower gusset which fits under the gap between adjacent tiles.

In general, it may be necessary that roof 120 be efficient at shedding water while resisting passage of water through roof 120 between tiles 102, 104, 106, 108 of tile assembly 110. In one aspect, referring to FIG. 6, a potential point of vulnerability of water intrusion is where the abutting inflection edges 150 of the left and right center tiles 102, 104 meet. The lower abutting inflection edges 150 are the left and right lateral apexes 136, 138 of the lower edges. They are exposed to rain and wind because of the streamlined nature of the tile, and the more streamlined a tile, the more exposed to wind and rain this area will be. A lower gusset 182, as shown in FIG. 8A, protects this junction against ingress of water. The upper abutting inflection edges 150 are also susceptible to ingress of water. Water flowing in the channel formed by the overlapping tiles on either side of the abutting inflection edges 150 could deliver water to this area. In one aspect, the upper abutting inflection edges 150 act as a dam for this water. Some water in this area that does not move elsewhere could ingress between the tiles at the inflection edges 150. An upper gusset 180, as shown in FIG. 8B, would protect against ingress of water between the inflection edges 150 in this area.

FIG. 8A illustrates a lower gusset 182 in a tile assembly with a right center tile 104 removed. In one embodiment, lower gusset 182 conforms closely to the angles of the two abutting inflection edges 150 and brides the gap to contain and redirect any water that comes through the gap. This water is redirected back onto the main surface 130 through an opening between the abutting inflection edges 150 where the edges 150 meet the main surface 130. The lower gusset 182 also acts to keep the abutting inflection edges 150 (and thereby the tiles) together, which acts to reduce or minimize the gap between the abutting inflection edges 150, thereby reducing or minimizing the ingress of water through the gap. In one aspect, at the bottom of the lower gusset 182 is an opening which allows water behind the lower gusset 182 to flow under the lower gusset 182 and out the gap onto the main surface 130.

Figure 8B:
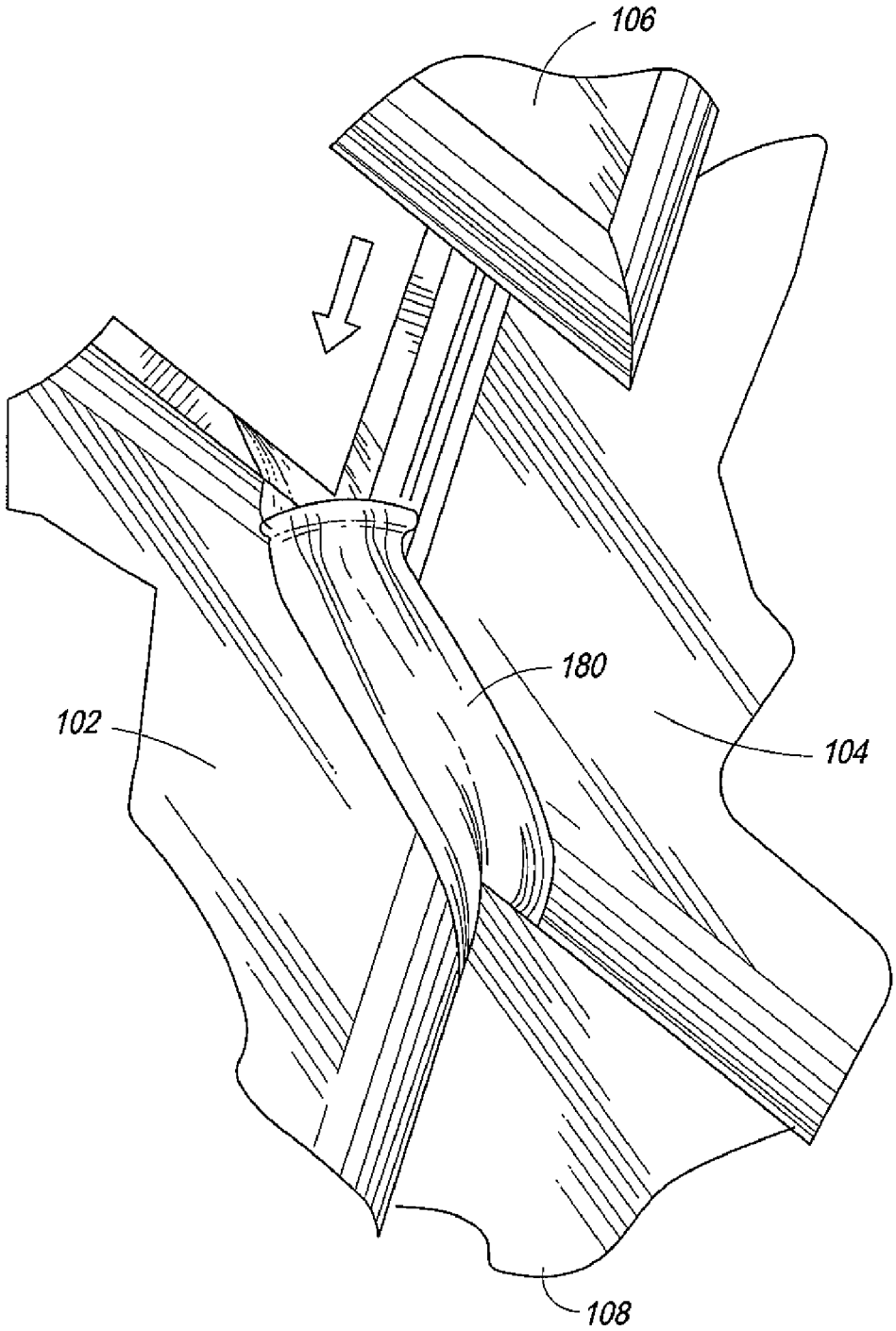
FIG. 8B is a perspective view of an upper gusset positioned so as to overlap the gap between adjacent tiles.

FIG. 8B illustrates an upper gusset 180 positioned so as to overlap the gap between inflection edges 150 of adjacent tiles 102, 104, 106, 108. In one embodiment, upper gusset 180 inhibits the passage of water between inflection edges 150 of adjacent center tiles 102, 104. Upper gusset 180, which may be molded from various types of suitable water impervious, moldable, stiff, thin, material, such as, for example, plastic, resin impregnated fiberglass, composite material, or the like, is shaped to fit over and extend the length of the line between inflection edges 150 above main surfaces 130 of adjacent tiles 102, 104, 106, 108. Upper gusset 180 can be placed in position by the installer at the time of installation. In one aspect, if water should leak between main surface 130 of adjacent tiles 102, 104, 106, 108 and flanges 140, 142 and run toward the line between inflection edges 150, upper gusset 180 can assist in protecting against the passage of such water between the edges 150 so as to divert the water downwardly on the outer surface of an underlying tile. In one aspect, upper gusset 180 may be shorter than shown in FIG. 8B, not covering the lower inflection edges 150 and not visible when tiles 102, 104, 106, 108 are assembled.

In use and operation, the installer can proceed along roof 120, securing tiles 102, 104, 106, 108 of tile assembly 110 to the laths 190 of roof 120 in a continuous sequence of overlapping and underlapping tiles, whereby each tile 102, 104, 106, 108 can form at least part of tile assembly 110. Thus, roof 120 can include numerous groupings of four tile assemblies 110 disposed in the form of a diamond shaped pattern. In one aspect, each tile 100 on the assembled roof 120 includes tiles 102, 104, 106, 108 as a group with additional groups of tiles surrounding it. In one aspect, the overall effect is to provide an attractive, diamond pattern roof 120 having a streamline appearance, which is aesthetically attractive, and which contributes to reduced wind resistance. The relationship of overlapping flanges 140, 142 is also intended to provide for efficient drainage of water from the surface of roof 120 and to reduce intrusion of water through it. Also, inclusion of inflection edges 150 and oversized nail installation apertures 172 permit installation despite structural variations of tiles 102, 104, 106, 108 in the manufacturing process and inaccuracies of alignment by the installer.

Figure 10A:
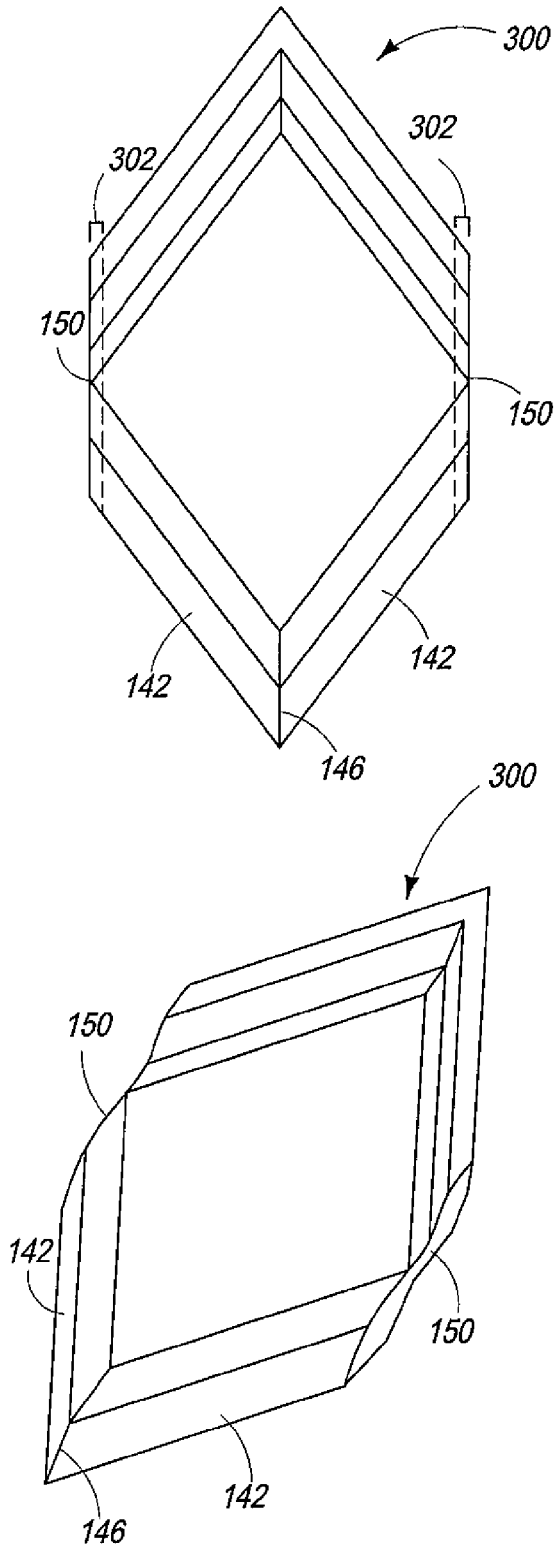
Figure 10B:
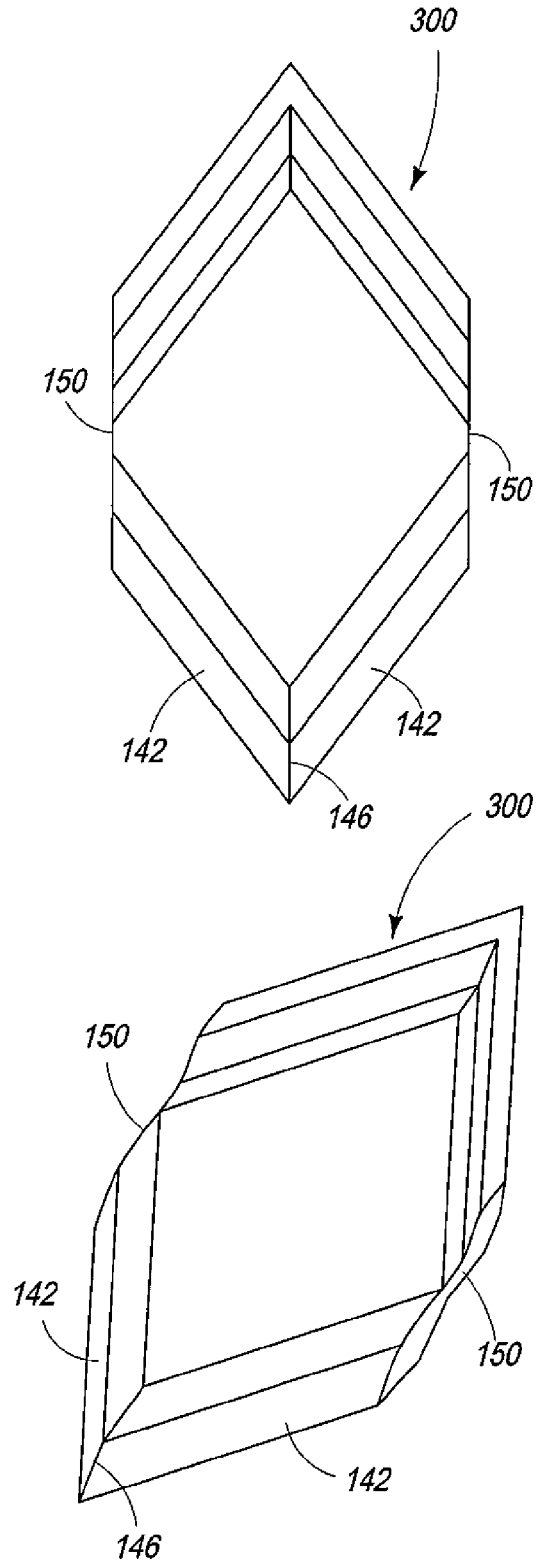

FIG. 10A top and bottom illustrates a portion 302 indicated with a dashed line that can be removed from tile 100 shown in FIG. 4. FIG. 10B top and bottom illustrates one embodiment of a narrowed tile 300, and FIG. 10B illustrates tile 300 with portion 302 removed and having a width of at least less than tile 100 shown in FIG. 4. The isometric views of 10A and 10B are shown below each. In general, the width of tiles 100, 300 is defined between inflection edges 150. One advantage of utilizing narrowed tiles 300 for a tile assembly is that a narrowed tile 300 can fit into a narrower horizontal roof space, thereby allowing the tile system to fit into a smaller area. In this type of application narrowing of the tile on one side only can be done. The narrowing of tiles can be used to fit tiles onto a rounded roof, making the top narrower than the bottom.

In one aspect, width of narrowed tile 300 can be formed, without changing the tile angles as previously described in reference to tile 100 of FIG. 1, by effectively shaving tile 100 along the inflection edges 150 on each side of the tile to form new inflection edges parallel to the original inflection edges. Narrowed tile 300 further reduces the effects of wind on tile 300 and can allow for adjustment in the placement of tiles to fit into a given space. This embodiment of narrowed tile 300 allows the lower flange apex 146, overhanging the two lower flanges 142 below it, to continue in a smooth contour to thereby reduce wind resistance and eliminates the protruding flange tip over the inflection edges below. In one embodiment, narrowed tile 300 can also provide a slightly different aesthetic on the finished roof 120, as shown in FIGS. 3A-3C.

Figure 11A:
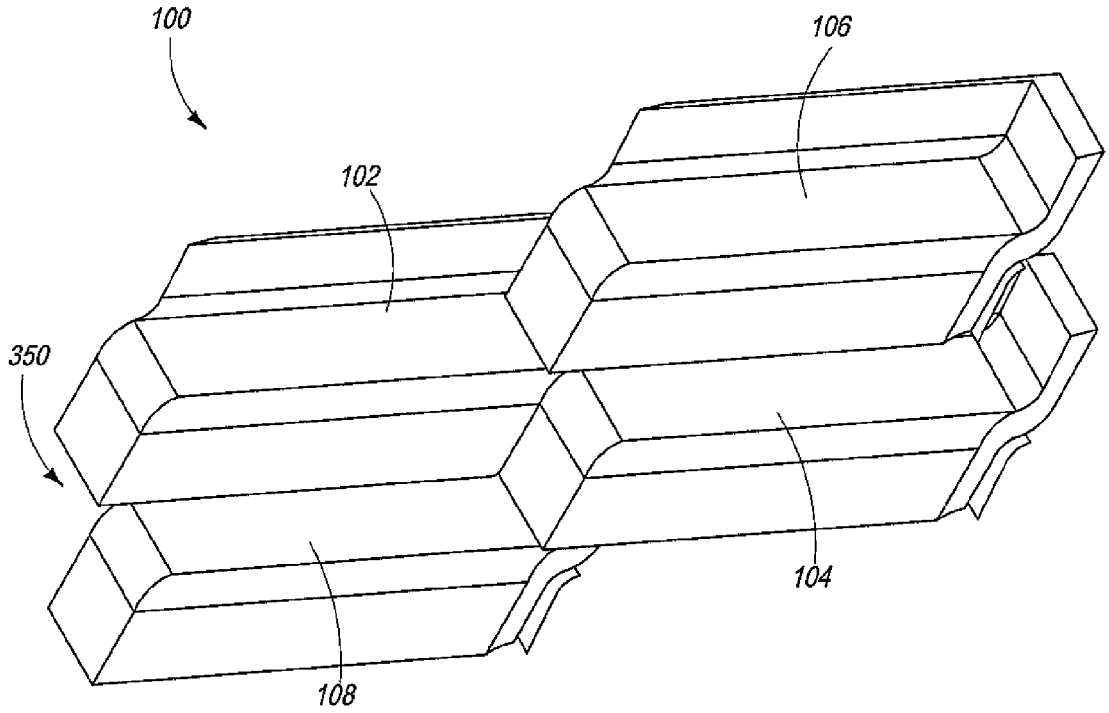
FIG. 11A is a perspective view of assembled tiles where the apex is protruding.
Figure 11B:
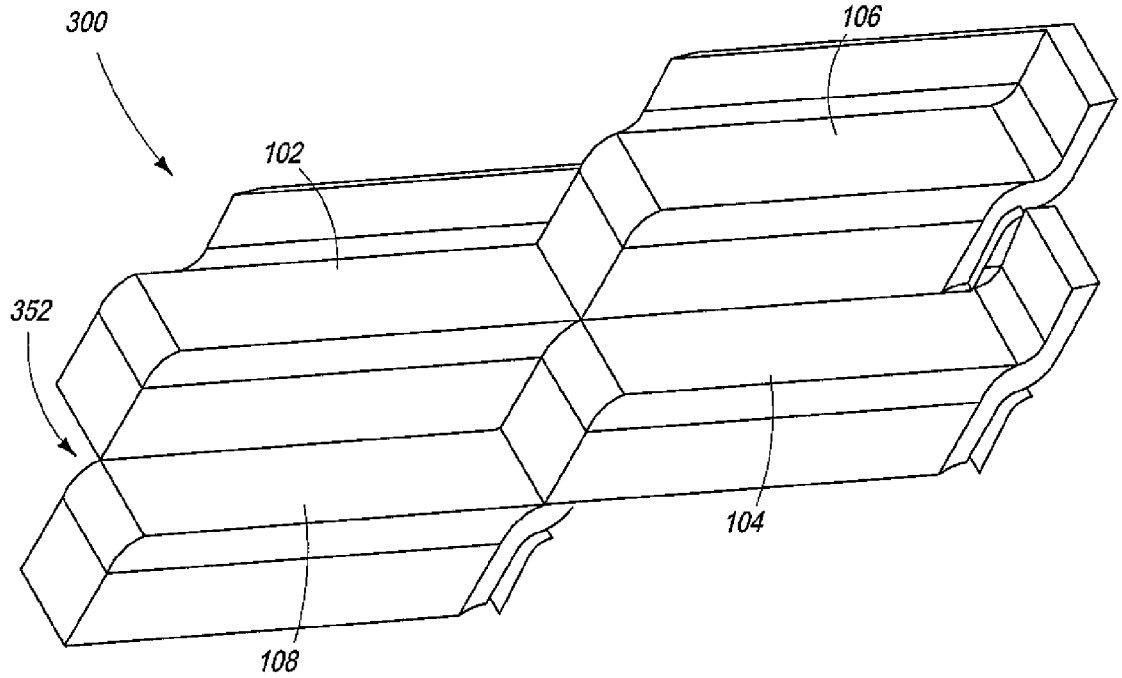
FIG. 11B is a perspective view of assembled narrowed tiles where the apex is non-protruding.
Figure 11C:
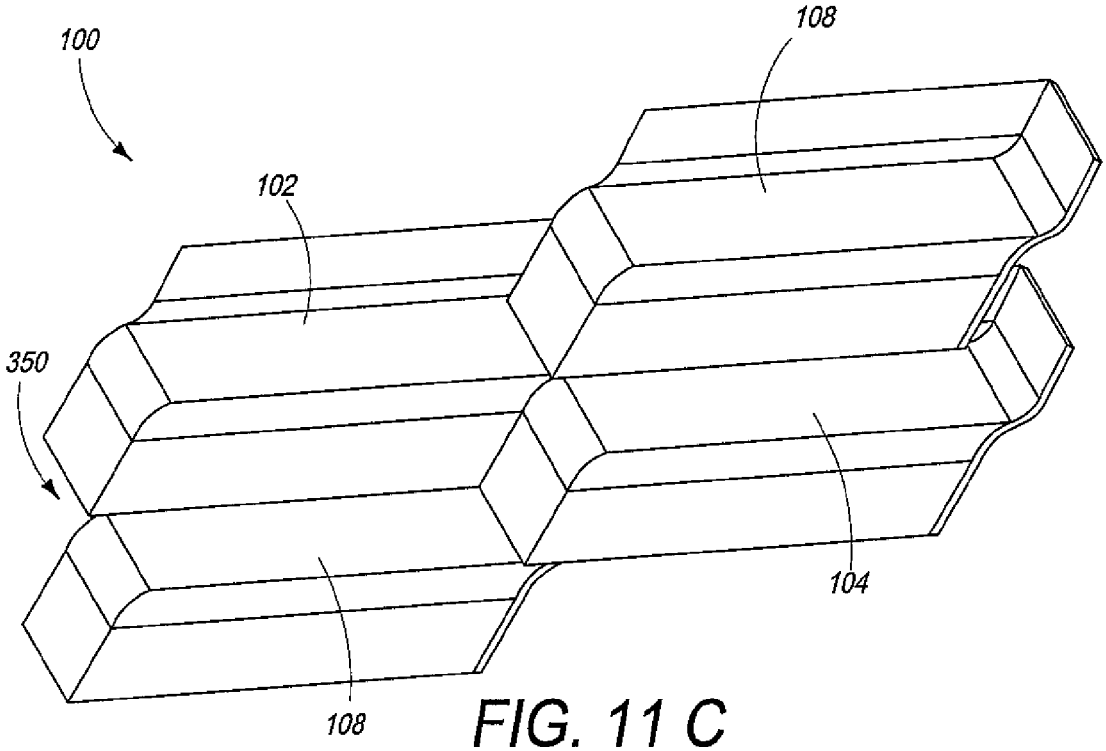
FIG. 11C is a perspective view of assembled tiles that are thin and where the apex is protruding.
Figure 11D:
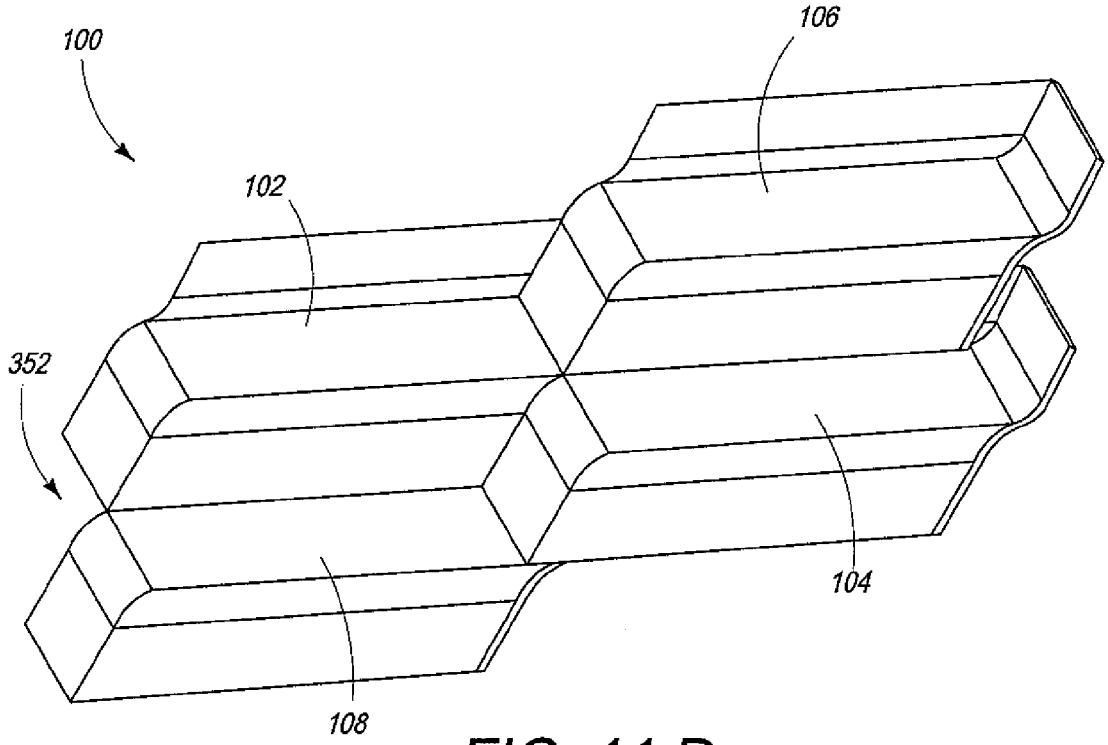
FIG. 11D is a perspective view of assembled narrowed tiles that are thin and where the apex is non-protruding.

FIG. 11A shows assembled tiles 100 having a protruding apex 350. FIG. 11B shows assembled narrowed tiles 300 having a non-protruding apex 352. FIG. 11C shows assembled tiles 100 that are thin with a protruding apex 350. FIG. 11D shows assembled narrowed tiles 300 that are thin with a non-protruding apex 352.

FIGS. 11A and 11C are not narrowed and of approximately the same size, with FIG. 11A having a significantly larger protruding apex 350 than FIG. 11C because the greater thickness of FIG. 11A. FIGS. 11B and 11D are both narrowed tiles 300 and both have no protruding apex 352 although they are of different thicknesses. The normal tiles 100 in FIG. 11A have a better upper edge catch basin than the narrowed tiles 300 of FIG. 11B because the upper flange apex protrudes under the inflection edges above it further in a direction up the roof. In one aspect, the catch basin effect of the normal tiles 100 decreases significantly with tile thickness.

In one aspect, the closeness of abutting lower inflection edges 150 of center tiles 102, 104 and the use of lower and upper gusset 180, 182 reduces rain penetration. In high rain and wind conditions, when the tiles 102, 104, 106, 108 are structurally imperfect, placed improperly on the roof, or the roof deck is uneven, rain water may penetrate and travel behind lower flanges 142 of center tiles 102, 104. This water can flow to the upper inflection edge intersection of lower tiles 108. In this instance, the trapped water can flow back out onto the exposed outer tile surfaces or pass through the upper infection edge intersection and be caught by upper flange apex 144 of lower tile 108. Should this process of penetrated water that runs behind lower flanges 142 occur at a large number of tile upper inflection edges intersections, the amount of trapped water at the upper flange inflection edge intersection can increase due to combining with water at upper inflection edges on lower rows of tiles. There can be an large enough amount of trapped water, depending on tile thickness and roof angle, that can overwhelm the basin characteristic of the upper flange apex 144 of the lower tile 108. In general, the thinner the tile and the flatter the roof, the more susceptible a given tile design will be. However, the present invention overcomes these problems by providing gussets 182, 180 and the following features.

Figure 9A:
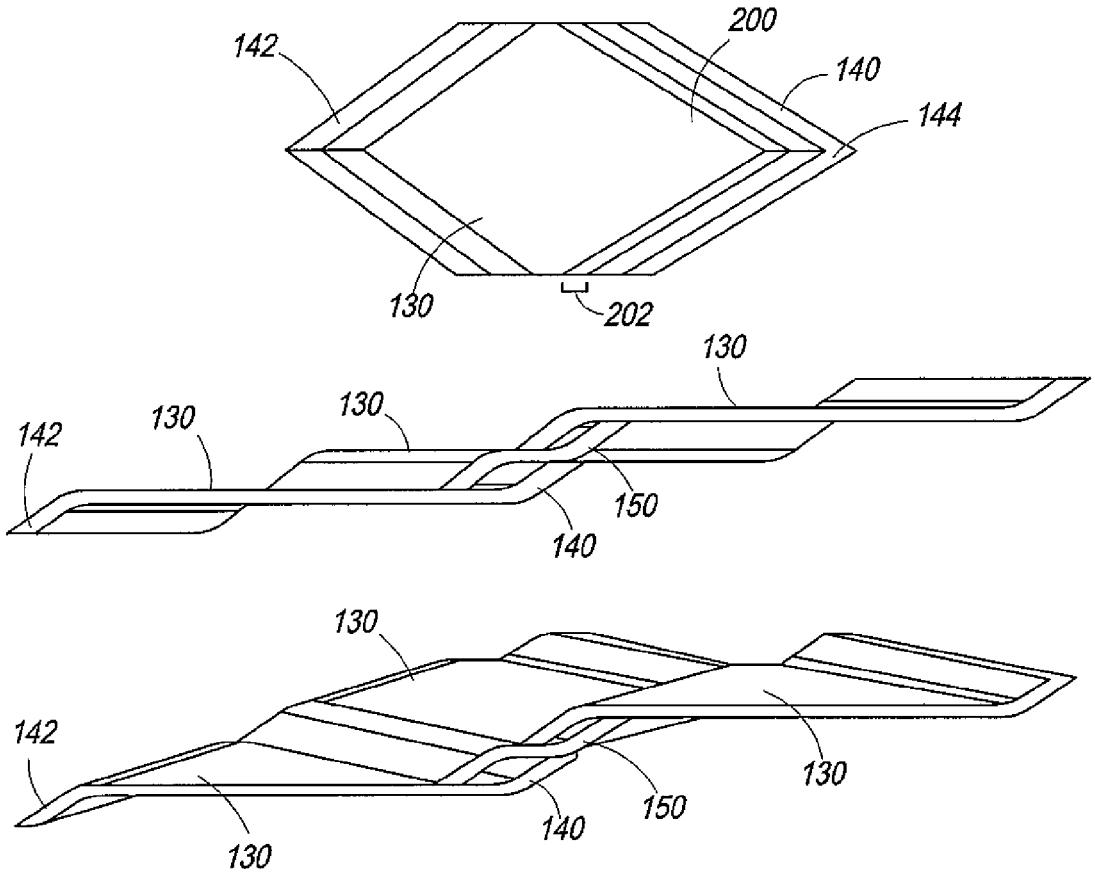
FIGS. 9A-9D illustrate various embodiments of a tile having an extended upper flange.
Figure 9B:
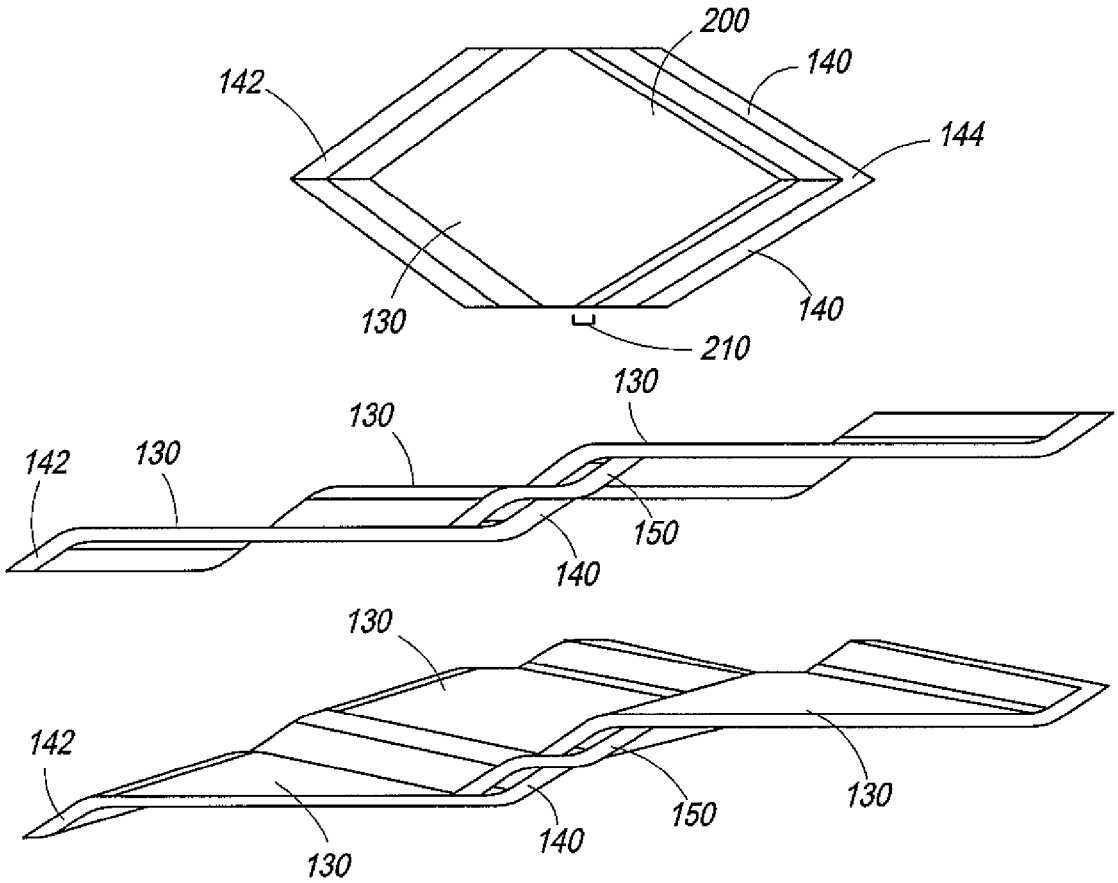
Figure 9C:
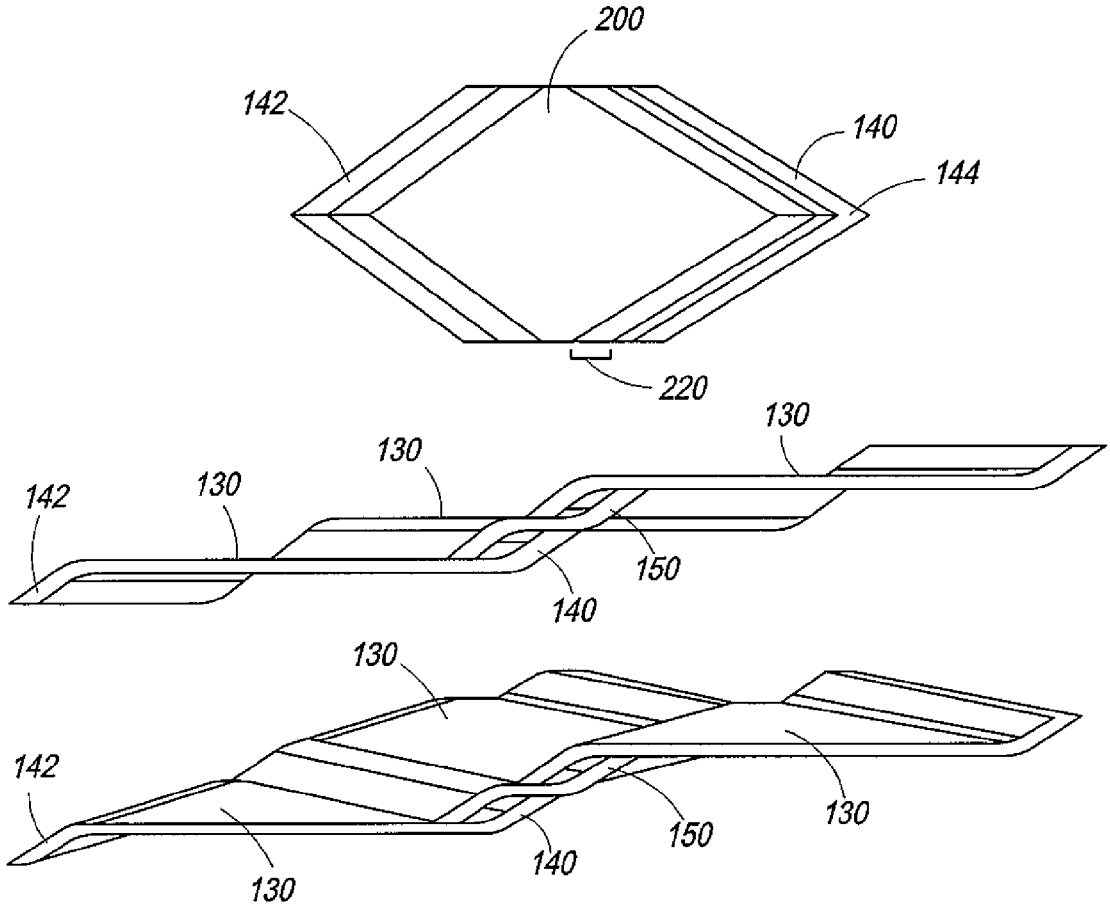
Figure 9D:
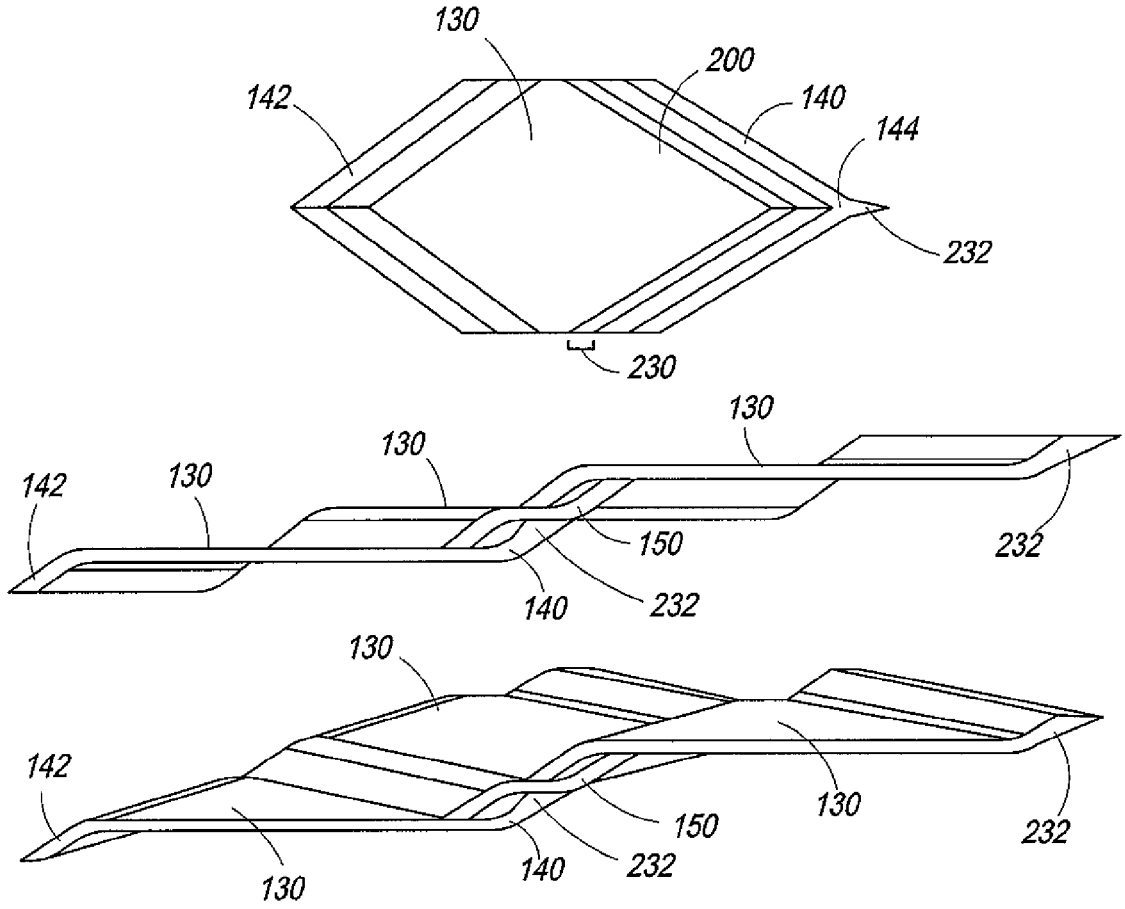
Figure 9E:
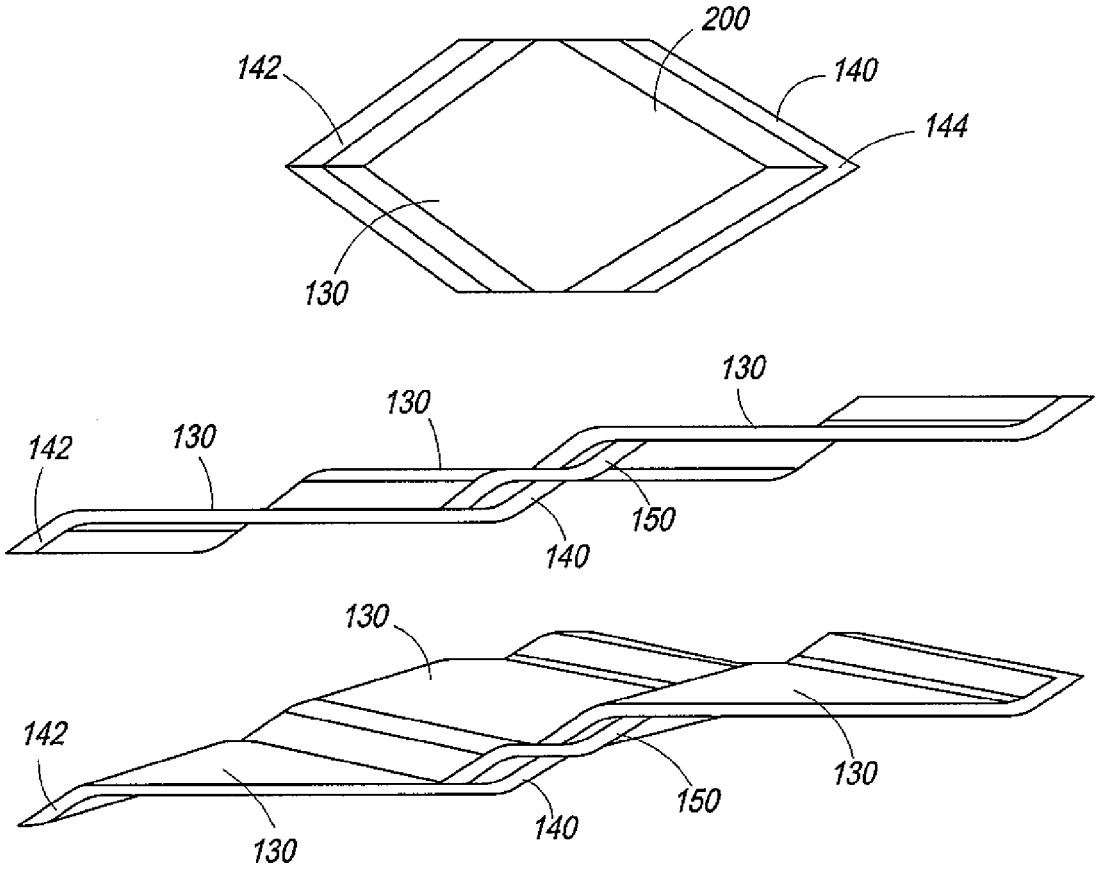
FIG. 9E is the same size tile without an improved upper edge catch basin for comparison.
Figure 9F:
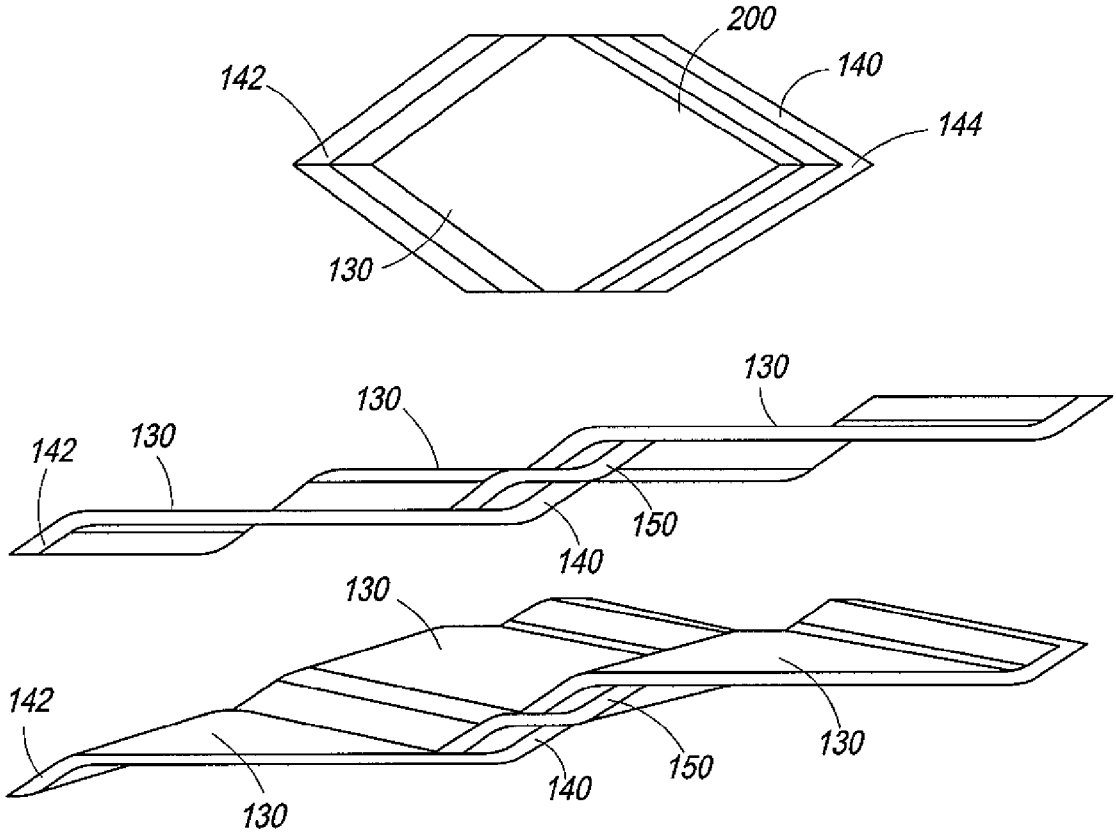

FIGS. 9A-9D illustrate various embodiments of a tile 200 that provides an extension or extended basin 202 of upper flange apex 144 and an improvement of the coverage from below for the upper portions of the inflection edges 150. In one embodiment, as shown in FIG. 9A, upper flange apex extension 202 is part of a sailboat shaped tile where the upper half of tile 200 has a smaller angle than the bottom half. This smaller angle includes the upper angle of main surface 130 and the angles of flanges 140, 144. In another embodiment, shown in FIG. 9B, upper flange apex extension 210 is due to upper flanges 140 flared out to give them a larger angle with main surface 130. Upper flanges 140 with extension 210 Are larger and cover more area of roof 120 than lower flanges 142 without extension 210. In still another embodiment, as shown in FIG. 9C, upper flange apex extension 220 is due to upper flanges 140 having a larger radius as they extend out from main surface 130. Upper flanges 140 with extension 220 are larger and cover more area of roof 120 than lower flanges 142 without extension 220. In yet another embodiment, as shown in FIG. 9D, upper flange extension 230 is due to an elongated flange apex 232. This can be from added mass and/or an extended deformation of flange apex 144. FIG. 9E illustrates a tile embodiment without the improved upper edge catch basin for comparison. FIG. 9F illustrates the same tile as in FIG. 9E with improved upper edge catch basin by means of tile placement. In FIGS. 9A-F the top drawing is a top view of a single tile, the middle drawing is a side view of three tiles with the top and bottom tiles cutaway vertically (bottom of roof to top); the bottom drawing is an isometric of the middle drawing.

To reduce the vulnerability of upper flange apex 144 to being overwhelmed by water as previously described above, the distance between the middle of each tile 102, 104, 106, 108 and upper flange apex 144 can be formed longer than the distance between the mid-tile and the lower flange apex 146. Upper flange apex 144 in the following described extended basin tile is at a higher position up the roof line relative to the abutting upper flange inflection edges 150 of the center tiles 102, 104 positioned above when compared with a tile embodiment without the extended basin. This method of extending the upper flange apex 144 may take, for example, four different forms, all of which do not effect the aesthetics, finished appearance, wind resistance, or wind characteristics of the tile system. FIG. 9F does not use a modified tile for an improvement in this relative positioning as described above, as it relies on a different tile placement, although the aesthetics and wind resistance are changed. The embodiment of FIG. 9A includes a smaller upper angle of the main diamond surface and flanges as compared to the lower angle of the main diamond surface and flanges. The embodiment of FIG. 9B includes a larger angle of the upper flange with the main surface as compared to the angle of the lower flanges with the main surface The embodiment of FIG. 9C includes a larger radius of the upper flanges as they extend from the main surface as compared to the radius the lower flanges as they extend from the main surface. The embodiment of FIG. 9D includes adding mass and/or a general deformation of the apex of the upper flanges in the direction vertically up the roof line. It should be appreciated by those skilled in the art that these methods may be used in combination. FIG. 9F shows an embodiment that can be used for providing an extended basin by placing a horizontal row of tiles lower on the row of tiles below it. The tip 146 of the top tile 106 is placed lower on the center tiles 102, 104 than normal, and this causes the tip 146 to be protruding. The protruding tip has different aesthetics and decreases wind resistance (protruding bottom edge tip apex). This type of placement can be used for fitting and adjusting tiles into a tight vertical space.

In one aspect, the tiles edges can be joined together with the main surfaces in a tight fitting configuration with very little space between edges and between edges and main surfaces. The overlapping and underlapping flanges provide a double row of structural support. This supportive structure and the tight fit of the tile assembly provide a roof system which can withstand weight loads.

In another aspect, the tile assembly 110, as described herein, can make use of thick materials such as clay and cement, and also thin materials such as metal and composites. It should be appreciated by those skilled in the art that tiles 100, 102, 104, 106, 108 for tile assembly 110 can include multiple materials for more choice in selecting roof materials and features, such as weight of a tile system, and weight of a tile system with a snow load. Moreover, thin and thick tiles 100, 102, 104, 106, 108 in tile assembly 110 could be positioned next to each other on the same roof 120.

In still another aspect, this tight fitting feature may provide additional protection for roof 120 in the form of resistance to fire embers due to the tight fitting assembly of tiles 102, 104, 106, 108 of tile assembly 110. The underlapping and overlapping flange structural support feature provides resistance to weight loads in snow conditions and in roof maintenance. The weight load resistance can be further enhanced with use of the lath 190 when mounting the tiles and tile assembly.

FIG. 13 illustrates a perspective view of an assembly of tiles with laths 190 for multiple rows of tiles, with these laths 190 having fasteners pre-installed to the proper height.

In one embodiment, insulation may be molded to fit under a number of tiles to make up an assembly of tiles, with or without an embedded lath, with assembly being attached to the subroof. The assemblies may fit together closely to provide an insulated roof with an associated installation labor savings.

In one embodiment, the tiles may have solar cells embedded into them or coated onto them through various manufacturing techniques. In these tiles, the lead conductors would be in place to connect from the solar cells to the inflection edges. The inflection edge conductors would make contact to electrical connectors which in turn, bring the electrical power onto the lath. The lath would be embedded with conductors which in turn connect the tiles to the power using devices.

While the description above refers to particular embodiments of the present invention, it will be understood that many modifications may be made without departing from the spirit thereof. In some instances, for aesthetic reasons, these modifications can take the form of tiles which change shape to make a pattern that involves multiple tiles. The accompanying claims are intended to cover such modifications as would fall within the true scope and spirit of the present invention.

The presently disclosed embodiments are therefore to be considered in all respects as illustrative and not restrictive, the scope of the invention being indicated by the appended claims, rather than the foregoing description, and all changes which come within the meaning and range of equivalency of the claims are therefore intended to be embraced therein.

What is claimed is:

1. A tile assembly for installation on a roof comprising:

a plurality of tiles having a main surface with upper and lower vertical apices and left and right lateral apices;

wherein the main surface is flat throughout;

at least two upper flanges extending peripherally directly from the main surface between the upper apex and lateral apices;

wherein the at least two upper flanges extend directly from the main surface at an obtuse angle in a first direction;

at least two lower flanges extending peripherally directly from the main surface between the lower apex and lateral apices;

wherein the at least two lower flanges extend directly from the main surface at an obtuse angle in a second direction;

wherein the first direction is directly opposite to the second direction such that the at least two upper flanges are parallel within 20 degrees to the at least two lower flanges with respect to the directions of extension from the main surface; and at least two inflection edges positioned at the lateral apices of each tile, wherein each inflection edge is defined by transition edges of the upper and lower flanges and an adjacent portion of the main surface;

wherein the plurality of tiles includes a left and right center tile positioned so as to abut at their adjacent inflection edges;

wherein the plurality of tiles includes an upper tile positioned with its two lower flanges overlapping the two adjacent upper flanges of the left and right center tiles; and wherein the plurality of tiles includes a lower tile positioned with its two upper flanges underlying the two adjacent lower flanges of the two center tiles.

2. The tile assembly of claim 1, wherein the tile assembly is adapted for installation on a roof extending in a plane inclined downwardly from a roof line of the roof and, when installed on the roof in multiplicity, defines a diamond patterned roof.

3. The tile assembly of claim 1, wherein each tile has a similar configuration, and wherein each tile has a generally diamond shaped main surface disposed in a plane nearly parallel to a roof plane of the roof.

4. The tile assembly of claim 1, wherein the upper and lower vertical apices of each tile are spaced along an axis nearly perpendicular to a roof line of the roof and the left and right lateral apices are spaced along an axis nearly parallel to the roof line.

5. The tile assembly of claim 1, wherein the upper flanges extend upwardly and outwardly at an obtuse angle from the main surface and includes an outer edge parallel to the main surface and a transition edge extending between the outer edge and the main surface, and wherein the upper flange edges are joined at an upper flange apex.

6. The tile assembly of claim 1, wherein the lower flanges extend downwardly and outwardly at an obtuse angle from the main surface and include an outer edge parallel to the main surface and a transition edge extending between the outer edge and the main surface, and wherein the lower flange edges are joined at a lower flange apex.

7. The tile assembly of claim 5, wherein the obtuse angle at which each of the flanges is inclined to the main surface is about 135 degrees.

8. The tile assembly of claim 5, wherein the obtuse angle at which each of said flanges is inclined to said main surface is within a range of about 120 to about 160.

9. The tile assembly of claim 1, wherein each inflection edge is generally perpendicular to the main surface.

10. The tile assembly of claim 1, wherein the transition edges of the upper and lower flanges bend via radiused regions from the main surface to extend in opposite, generally parallel directions, to provide an inflected configuration.

11. The tile assembly of claim 1, wherein each of the tiles includes a notch in each of its upper flanges in the transition edge thereof.

12. The tile assembly of claim 1, further comprising a plurality of nail fasteners each having a nail head that overlaps two of the tiles and a nail shaft extending from the nail head, wherein each of the tiles includes a notch in each of its upper flanges in the transition edge thereof extending perpendicularly to the roof plane and sized to receive the nail shaft, and wherein at least the center tiles are secured to the roof by the nail fasteners inserted through the notches in the upper flanges of the center tiles.

13. The tile assembly of claim 12, wherein the nail fastener further comprises semi-flexible material beneath the nail head that conforms to the contour of the inflection edges.

14. The tile assembly of claim 1, further comprising a lower gusset of water impervious material shaped to fit under the transition edges of the adjacent lower flanges of the center tiles and on top of the upper flange apex of the lower tile.

15. A tile assembly for a diamond patterned roof, for installation on a roof extending in a plane inclined downwardly from the roof line, the tile assembly comprising:

two, left and right, center tiles, each tile having a generally diamond shaped main surface disposed in a plane parallel to the roof plane and having upper and lower vertical apices spaced along an axis perpendicular to the roof line and left and right lateral apices spaced along an axis parallel to said roof line, wherein said main surface is flat throughout, two upper flanges extending peripherally directly from said main surface between its upper apex and its lateral apices, each said upper flange extending upwardly and outwardly at an obtuse angle in a first direction from said main surface and having an outer edge parallel to said main surface and a transition edge extending between said outer edge and said main surface, said upper flange edges being joined at an upper flange apex, two lower flanges extending peripherally directly from said main surface between its lower apex and its lateral apices, said lower flanges extending downwardly and outwardly at an obtuse angle in a second direction from said main surface and having an outer edge parallel to said main surface and a transition edge extending between said outer edge and said main surface, said lower flange edges being joined at a lower flange apex, wherein the first direction is directly opposite to the second direction such that the two upper flanges are parallel within 20 degrees to the two lower flanges with respect to the directions of extension from said main surface, and two inflection edges, positioned at the lateral apices of each tile, each inflection edge defined by the transition edges of said upper and lower flanges and an adjacent portion of said main surface, each inflection edge extending in a plane generally perpendicular to said main surface, said left and right center tiles abutting at their adjacent said inflection edges;

an upper tile having the same configuration as each of said center tiles, said upper tile being positioned with its two lower flanges overlapping the two adjacent upper flanges of the two center tiles; and a lower tile having the same configuration as each of said center tiles, said lower tile being positioned with its two upper flanges underlying the two adjacent lower flanges of the two center tiles.

16. A tile comprising:

a generally diamond shaped main surface with upper and lower vertical apices spaced apart along a vertical axis and left and right lateral apices spaced apart along a horizontal axis, wherein said main surface is flat throughout, two upper flanges extending peripherally directly from said main surface between its upper apex and its lateral apices, each said upper flanges extending upwardly and outwardly at an obtuse angle in a first direction from said main surface and having an outer edge parallel to said main surface and a transition edge extending between said outer edge and said main surface, said upper flanges being joined at an upper flange apex, two lower flanges extending peripherally directly from said main surface between its lower apex and its lateral apices, said lower flanges extending downwardly and outwardly at an obtuse angle in a second direction from said main surface and having an outer edge parallel to said main surface and a transition edge extending between said outer edge and said main surface, said lower flanges being joined at a lower flange apex, wherein the first direction is directly opposite to the second direction such that the two upper flanges are parallel within 20 decrees to the two lower flanges with respect to the directions of extension from said main surface, and two inflection edges positioned at the lateral apices of each tile, each inflection edge defined by the transition edges of said upper and lower flanges and an adjacent portion of said main surface, each inflection edge extending in a plane generally perpendicular to said main surface; and two notches, one in each upper flange in the region thereof defining said inflection edge.

17. The tile assembly of claim 1, wherein the tiles are formed of plastic, cement, metal, composites, or clay.

18. The tile assembly of claim 14, wherein the lower gusset includes an opening at a bottom portion of the lower gusset.

19. The tile assembly of claim 1, wherein the upper flanges are longer than the lower flanges.

20. The tile assembly of claim 1, further comprising a solar cell embedded in the tiles or coated on the tiles.

* * * * *